US008960106B2

(12) United States Patent
Kumazawa

(10) Patent No.: US 8,960,106 B2
(45) Date of Patent: Feb. 24, 2015

(54) DESK

(75) Inventor: Taku Kumazawa, Nagoya (JP)

(73) Assignee: Aichi Co., Ltd., Aichi-Ken (JP)

( * ) Notice: Subject to any disclaimer, the term of this patent is extended or adjusted under 35 U.S.C. 154(b) by 1377 days.

(21) Appl. No.: 11/803,367

(22) Filed: May 14, 2007

(65) Prior Publication Data

US 2007/0261611 A1 Nov. 15, 2007

(30) Foreign Application Priority Data

May 15, 2006 (JP) ..... 2006-135638
May 15, 2006 (JP) ..... 2006-135639
May 15, 2006 (JP) ..... 2006-135640
May 15, 2006 (JP) ..... 2006-135641

(51) Int. Cl.
*A47B 91/00* (2006.01)
*A47B 13/00* (2006.01)
*A47B 47/00* (2006.01)
*A47B 3/06* (2006.01)
*A47B 3/08* (2006.01)

(52) U.S. Cl.
CPC ..... *A47B 3/0815* (2013.01)
USPC ..... 108/158.12; 108/153.1

(58) Field of Classification Search
USPC ..... 108/153.1, 150, 151, 115, 158.11, 108/158.12, 118; 248/188, 188.1, 188.8; 403/344, 346, 400
See application file for complete search history.

(56) References Cited

U.S. PATENT DOCUMENTS 2,676,044 A * 4/1954 Gorman et al. ..... 403/346
4,322,087 A * 3/1982 Addicks ..... 280/279
4,616,949 A * 10/1986 Kellner ..... 403/104
4,900,183 A * 2/1990 Souchko ..... 403/385
5,205,526 A * 4/1993 Deutsch ..... 248/449
5,673,882 A * 10/1997 Huang ..... 248/188.8
5,909,713 A * 6/1999 Liaw ..... 108/119
5,967,631 A * 10/1999 Ko ..... 312/194
6,135,032 A * 10/2000 Ko ..... 108/96
6,341,764 B1 * 1/2002 Conner ..... 256/65.12
6,786,672 B2 * 9/2004 Ledingham ..... 403/400

(Continued)

FOREIGN PATENT DOCUMENTS

JP S61035099 10/1986
JP H01178209 12/1989

(Continued)

OTHER PUBLICATIONS

Concise Explanation of Relevance on Non-English References Submitted With Information Disclosure Statement, May 28, 2009.

(Continued)

*Primary Examiner* — Daniel J Troy
*Assistant Examiner* — Andres F Gallego
(74) *Attorney, Agent, or Firm* — Kinney & Lange, P.A.

(57) ABSTRACT

A desk includes a top panel and at least one leg portion. At least one of the at least one leg portion includes a pole-shaped leg pole that supports the top panel and a leg support that has at least a part abutting a floor surface and is attached to the leg pole so as to support the leg support. The leg support includes, as devices to connect with the leg pole, a pair of sandwiching portions that abut the leg pole and are capable of sandwiching the leg pole therebetween and a fastening device that fastens and connects the pair of sandwiching portions in a state where the leg pole is sandwiched by the pair of sandwiching portions.

15 Claims, 20 Drawing Sheets

(56) References Cited

U.S. PATENT DOCUMENTS

| | | | | |
|---|---|---|---|---|
| 6,810,820 | B1 * | 11/2004 | Okerlund et al. | 108/147 |
| 6,872,027 | B2 * | 3/2005 | Ledingham | 403/400 |
| 7,066,098 | B2 * | 6/2006 | Blasen et al. | 108/115 |
| 2003/0090137 | A1 * | 5/2003 | Piretti | 297/335 |
| 2004/0238714 | A1 * | 12/2004 | Slatter et al. | 248/534 |

FOREIGN PATENT DOCUMENTS

| | | | | |
|---|---|---|---|---|
| JP | 3056788 | | | 5/1991 |
| JP | 3099894 | | | 10/1991 |
| JP | 3099894 | U | | 10/1991 |
| JP | H07031405 | | | 6/1995 |
| JP | 7194435 | | | 8/1995 |
| JP | H07194435 | | | 8/1995 |
| JP | 2532189 | | | 1/1997 |
| JP | H09313289 | A | | 12/1997 |
| JP | 10127351 | A | | 5/1998 |
| JP | H10179267 | | | 7/1998 |
| JP | 10215952 | A | * | 8/1998 |
| JP | H11262413 | | | 9/1999 |
| JP | H11318572 | A | | 11/1999 |
| JP | 2000217839 | A | | 8/2000 |
| JP | 2000262330 | A | | 9/2000 |
| JP | 2004 121441 | | | 4/2004 |
| JP | 2004 357980 | | | 12/2004 |
| JP | 2004357980 | A | | 12/2004 |

OTHER PUBLICATIONS

Concise Explanation of Relevance of Non-English References submitted with Information Disclosure Statement, Jun. 4, 2009.

English Translation of Search Report prepared by private firm for Japanese Application No. 2006-135638.

English Translation of Search Report prepared by private firm for Japanese Application No. 2006-135639.

English Translation of Search Report prepared by private firm for Japanese Application No. 2006-135640.Engli.

English Translation of Search Report prepared by private firm for Japanese Application No. 2006-135641.

Notification of Reason(s) for Rejection of the Japanese Patent Office dated May 13, 2011, in foreign counterpart application No. 2006-135638, filed May 15, 2006.

* cited by examiner 8
8h
8k
31b
27a
41
43
43e
21e
21h
21
21a
31
33
31a
27b
10b
25
F
43b
43c
43f
43d
43a
21g
21f
21d
21j
21k
45
47
45a
35
21b
21c 8
8h
41
65b
65c
65
65a
8k
65d
61f
61e
61h
61d
61g
61
10b
25
27a
35
61b
61a
61c
27b
F
67
69a
69
31
33
31a
31b
61h 91
91a
93
95b
95c
95d
95a
95e
95
91b
27a
61e
61h
61d
61
61b
61a
61c
27b
10b
25
F 91
91a
27a
95c
95d
61h
61d
61
27b
10b
25
F 91
91a
27a
61e
95c
61d
61
27b
10b
25
F

DESK

CROSS-REFERENCE TO RELATED APPLICATIONS

This application claims the benefit of Japanese Patent Applications Nos. 2006-135638, 2006-135639, 2006-135640, and 2006-135641 filed May 15, 2006 in the Japanese Patent Office, the disclosures of which are incorporated herein by reference.

BACKGROUND OF THE INVENTION (i) Field of the Invention

The present invention relates to a desk or a table provided with a pole-shaped leg pole that supports a top panel and a leg support that supports the leg pole.

(ii) Background Art

A typical known desk includes a top panel and at least one leg portion. The at least one leg portion includes a pole-shaped leg pole that supports the top panel, and a leg support that is attached to the leg pole at a position lower than a top panel support portion of the leg pole to support the leg pole. There have been proposed various techniques for fixing the leg support to the leg pole.

In one technique, the leg support and the leg pole are integrally formed of a resin or the like. When the leg pole and the leg support are made of metals, the leg support is connected to the leg pole by welding. In another technique, an insertion hole is formed in each of the leg pole and the leg support, and the leg pole and the leg support are riveted while a rivet is inserted through the insertion hole. Alternatively, a screw hole and an insertion hole are formed respectively in the leg pole and the leg support, and the leg pole and the leg support are connected with a screw.

SUMMARY OF THE INVENTION

However, when the leg pole and the leg support are connected by welding, the leg support cannot be easily replaced even if the leg support is, for example, broken or deformed. This makes repair difficult. When the leg support is connected to the leg pole with a screw, the leg support can be removed from the leg pole. However, since a connected state is maintained only by the screw, and a sufficient strength of the connected state cannot always be obtained depending on shapes and arrangements of the leg pole and the leg support.

Accordingly, it is desirable to provide a desk that includes a top panel and at least one leg portion, which has a leg pole supporting the top panel and a leg support supporting the leg pole, wherein the leg pole and the leg support may be securely connected and may also be removed.

The present invention provides a desk that includes a top panel and at least one leg portion. At least one of the at least one leg portion includes a pole-shaped leg pole that supports the top panel and a leg support that has at least a part abutting a floor surface and is attached to the leg pole so as to support the leg support. The leg support includes, as devices to connect with the leg pole, a pair of sandwiching portions that abut the leg pole and are capable of sandwiching the leg pole therebetween and a fastening device that fastens and connects the pair of sandwiching portions in a state where the leg pole is sandwiched by the pair of sandwiching portions.

In the present invention as described above, the leg support includes the pair of sandwiching portions and the fastening device, and the pair of sandwiching portions are fastened and connected by the fastening device in the state where the leg pole is sandwiched by the pair of sandwiching portions.

According to the desk of the present invention, in which the leg pole and the leg support are connected by a pressure by the sandwiching portions, a secure connection with a sufficient strength may be achieved. Also, the leg support may easily be removed from the leg pole by releasing the fastening of the sandwiching portions by the fastening device.

It is to be noted that the desk may be a table.

BRIEF DESCRIPTION OF THE DRAWINGS

Preferred embodiments of the present invention will be described hereinafter with reference to the drawings, in which.

DETAILED DESCRIPTION OF THE PREFERRED EMBODIMENTS

Figure 2B:
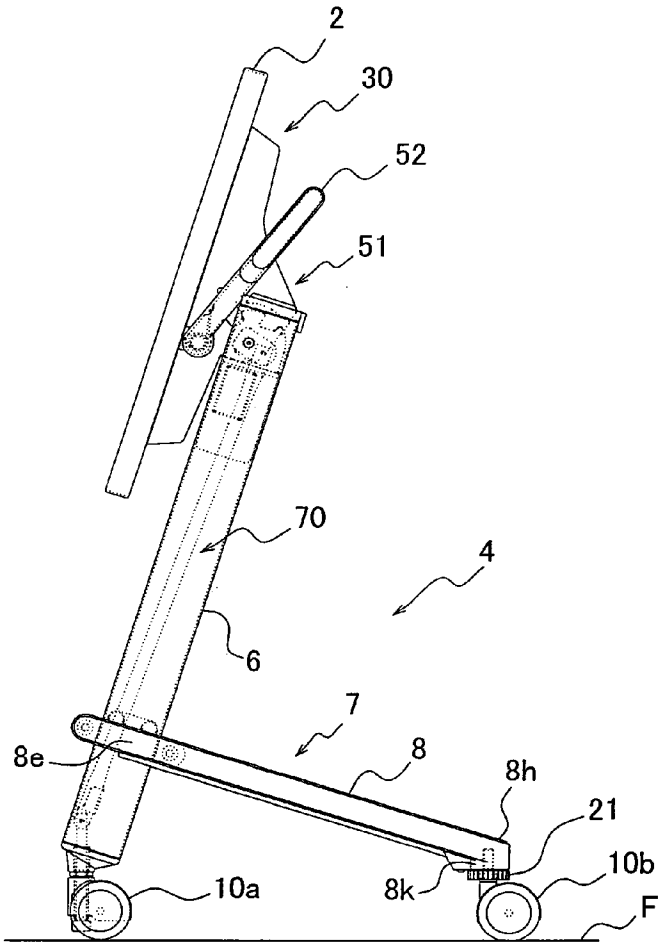
FIG. 2B is a side elevational view showing an appearance of the movable desk when the top panel is in a storage position.

A movable desk 1 is configured to be immovable relative to a floor surface F when a top panel 2 is in a substantially horizontal in-use position (see FIG. 2A) and movable relative to the floor surface F when the top panel 2 is in a substantially vertical storage position (see FIG. 2B).

Figure 1:
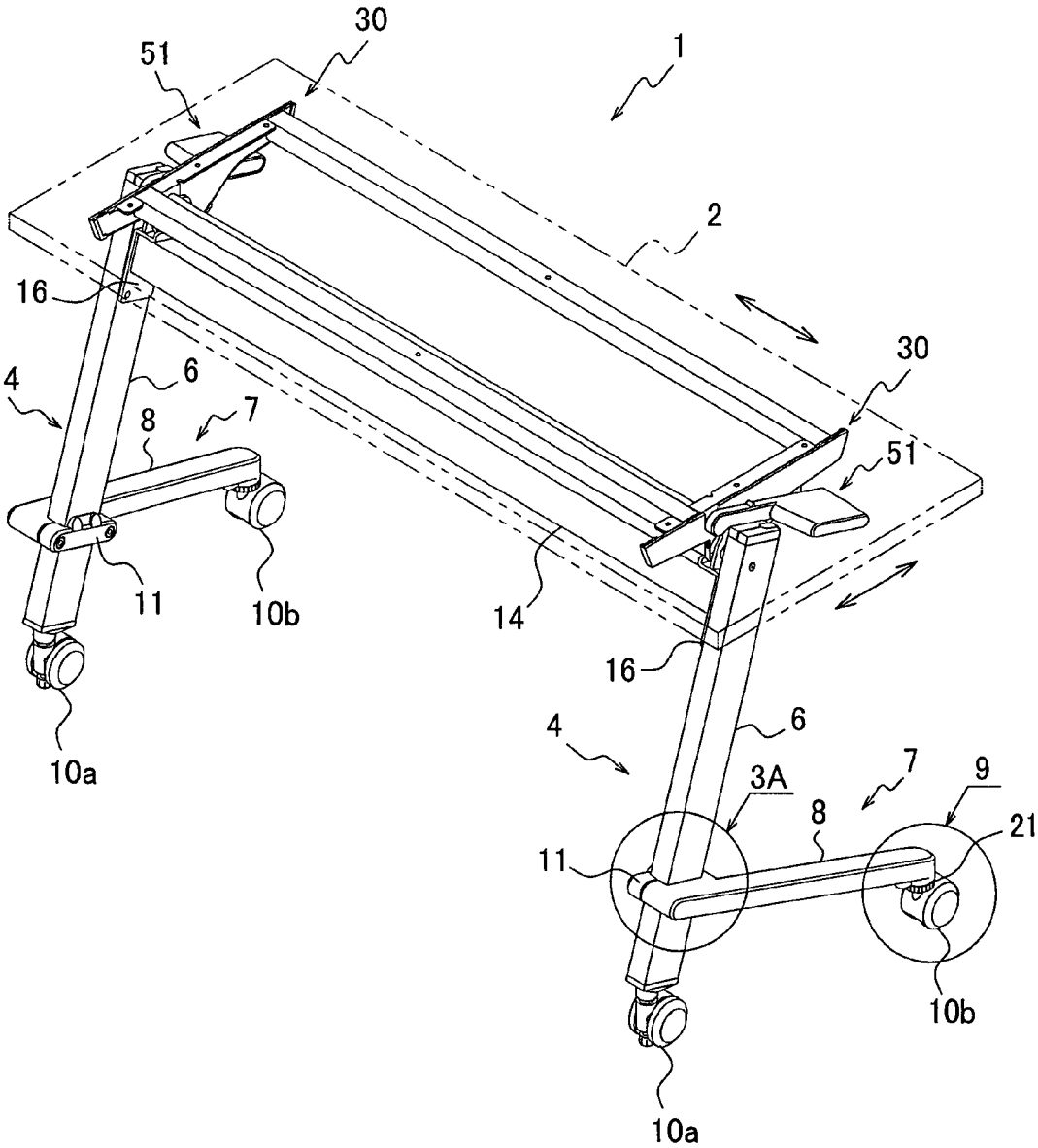
FIG. 1 is a perspective view showing an appearance of a movable desk with a top panel indicated by dashed double dotted lines in a present embodiment.
Figure 2A:
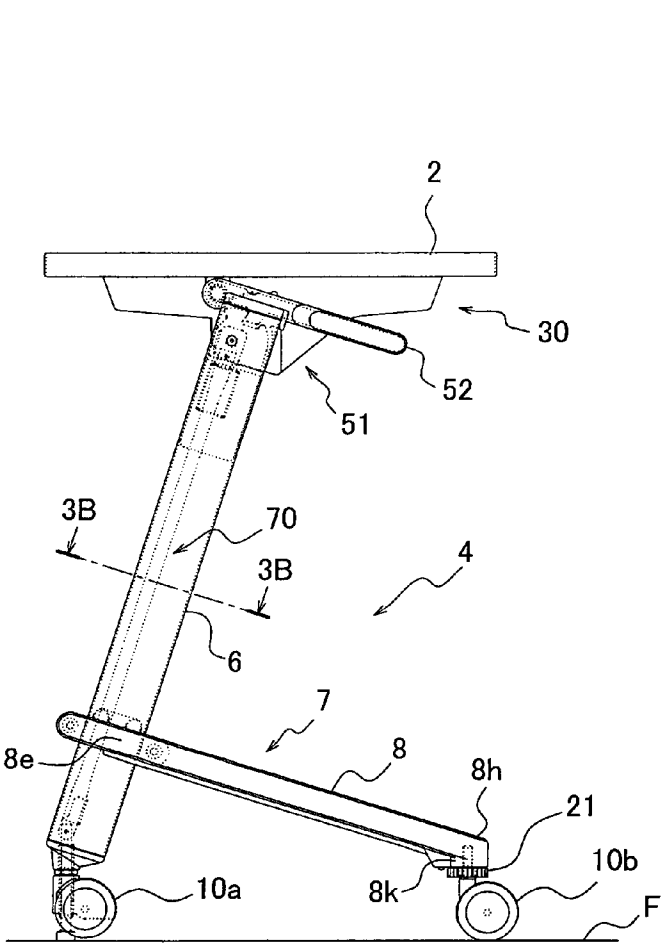
FIG. 2A is a side elevational view showing an appearance of the movable desk when the top panel is in an in-use position.

As shown in FIG. 1, FIG. 2A and FIG. 2B, the movable desk 1 includes the top panel 2, a pair of top panel support portions 30, a pair of legs 4 and a pair of brake mechanisms 70.

The top panel 2 is made of a rectangular plate material.

The top panel support portions 30 are secured to an under surface of the top panel 2 at respective longitudinal end portions of the top panel 2.

The legs 4 rotatably support the top panel 2 and the top panel support portion 30 between the in-use position and the storage position. Each of the legs 4 is provided with caster portions 10 (first and second caster portions 10*a* and 10*b*) at lower ends thereof.

Each of the brake mechanisms 70 is provided within each of the legs 4 in order to prevent movement of the movable desk when the top panel 2 is in the in-use position.

Hereinafter, a description will be provided under the following definitions: A right and left direction of the movable desk 1 is a longitudinal direction of the top panel 2. A front and rear direction of the movable desk 1 is a direction perpendicular to the longitudinal direction. A rear of the movable desk 1 is a side on which a chair is to be placed (i.e., a right side in FIG. 2A and FIG. 2B). A front of the movable desk 1 is a side opposite to the side on which the chair is to be placed.

Each of the legs 4 includes a leg pole 6 and a leg support 7. The leg pole 6 is disposed in an upper and lower direction with an upper end of the leg pole 6 slightly slanting rearward. A front end portion of the leg support 7 is connected to the leg pole 6 at a position slightly lower than a central part of the leg pole 6, and the leg support 7 is disposed in the front and rear direction.

Figure 3A:
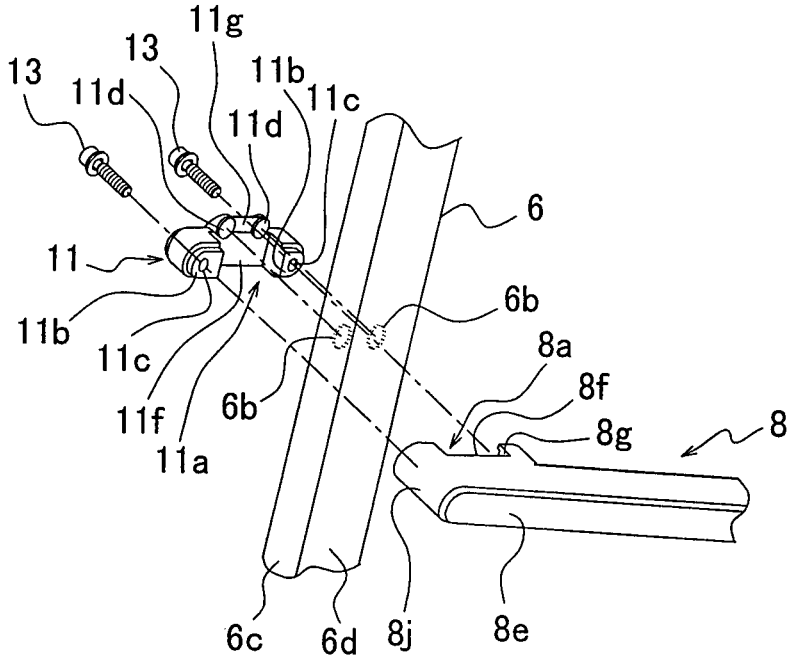
FIG. 3A is an enlarged exploded perspective view of a circled area 3A in FIG. 1 showing in detail an attachment structure between a leg pole and a leg support.

The leg pole 6 includes a tubular longitudinal member having a rectangular cross section. The first caster portion 10*a* is provided to a lower end of the longitudinal member. As shown in FIG. 3A, the tubular longitudinal member includes a pair of opposing first side walls 6*c* having a smaller width and a pair of opposing second side walls 6*d* having a larger width. The first side walls 6*c* are disposed in the front and rear direction, while the second side walls 6*d* are disposed in the right and left direction. One of the second side walls 6*d* disposed inward of the movable desk 1 is provided with two circular engagement holes 6*b*. The engagement holes 6*b* are located slightly lower than a central part of the second side wall 6*d* and apart from each other along a direction perpendicular to a longitudinal direction of the second side wall 6*d*.

Figure 3B:
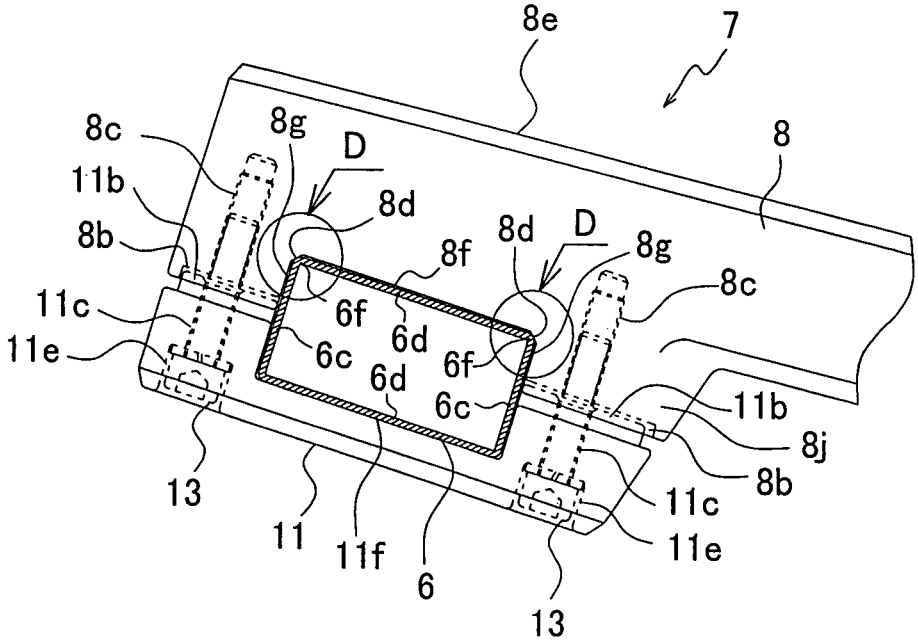
FIG. 3B is a cross sectional view taken along line 3B-3B in FIG. 2A showing in detail the attachment structure between the leg pole and the leg support.

As shown in FIG. 3A and FIG. 3B, the leg support 7 includes an elongated leg support main body 8, a leg support attachment member 11 for attaching the leg support main body 8 to the leg pole 6, and two attachment bolts 13.

The leg support main body 8 includes a linear metal rod member having a rectangular cross section. As shown in FIG. 2A and FIG. 2B, a rear end portion 8*h* of the leg support main body 8 partially includes a protruding portion 8*k* protruding downward. The second caster portion 10*b* and an adjuster 21 fixed to the second caster portion 10*b* are provided to the protruding portion 8*k*. A height of the rear end portion 8*h* of the leg support main body 8 from the floor surface F, and thus a height of the leg support 7 from the floor surface F, can be adjusted by manually rotating the adjuster 21 from outside.

As shown in FIG. 3A and FIG. 3B, a front end portion 8*e* of the leg support main body 8 to be connected to the leg pole 6 includes a protruding portion 8*j* protruding inward of the movable desk 1 and having a substantially elliptical cross section.

An engagement groove 8*a* engageable with the leg pole 6 is formed in a central part of the protruding portion 8*j* so as to extend in a direction perpendicular to a longitudinal direction of the leg support main body 8. A width of the engagement groove 8*a* is slightly larger than the width of the second side wall 6*d* of the leg pole 6. A depth of the engagement groove 8*a* is substantially half of the width of the first side wall 6*c* of the leg pole 6. A bottom surface 8*f* and a pair of parallel side surfaces 8*g* of the engagement groove 8*a* are connected via surfaces 8*d* as shown in circled areas D, D in FIG. 3B. Each of the surfaces 8*d* has an angle of 45 degrees with respect to the bottom surface 8*f* and an adjacent one of the side surfaces 8*g*.

Each of end surfaces of the protruding portion 8*j* separated by the engagement groove 8*a* includes a concave portion 8*b* which is engageable with a part of the leg support attachment member 11. A screw hole 8*c* is formed in a central part of the concave portion 8*b* into which the attachment bolt 13 can be screwed.

The leg support attachment member 11 is a block having a substantially elliptical cross section. The cross section has a configuration substantially the same as a configuration of the protruding portion 8*j* of the leg support main body 8.

An engagement groove 11*a* engageable with the leg pole 6 is formed in a central part of the leg support attachment member 11 so as to extend in a direction along a shorter side of the leg support attachment member 11. The engagement groove 11*a* has a same width as the width of the engagement groove 8*a*.

Each of end surfaces of the leg support attachment member 11 separated by the engagement groove 11*a* includes a convex portion 11*b* which is engageable with the concave portion 8*b* of the leg support main body 8. An insertion hole 11*c* is formed in a central part of the convex portion 11*b* through which the attachment bolt 13 can be inserted.

The convex portion lib has a height such that a gap is formed between an end surface of the convex portion 11*b* and a bottom surface of the concave portion 8*b* when the leg support attachment member 11 is engaged with the leg pole 6 through the engagement groove 11*a* and the leg support main body 8 is engaged with the leg pole 6 through the engagement groove 8*a* as opposed to the leg support attachment member 11 with the leg pole 6 located therebetween.

The leg support attachment member 11 includes an extending portion 11*g* extending from one end of a bottom surface 11*f* of the engagement groove 11*a*. The extending portion 11*g* includes two circular projections 11*d* projecting toward an opening direction of the engagement groove 11*a*. The projections 11*d* are respectively engageable with the two engagement holes 6*b* formed in the leg pole 6 when the engagement groove 11*a* is engaged with the leg pole 6.

The leg support attachment member 11 also includes, in a face opposite to a face in which the engagement groove 11*a* is formed, two counterbores 11*e* formed around the respective insertion holes 11*c*. Each of the counterbores 11*e* is receivable of a head of the bolt 13.

When the leg support attachment member 11 is engaged with the leg pole 6 from an inner side of the leg pole 6 through the engagement groove 11*a* with the extending portion 11*g* located in an upper part, the projections 11*d* of the extending portion 11*g* are engaged with the engagement holes 6*b*.

The leg support main body 8 is engaged with the leg pole 6 from an outer side of the leg pole 6 through the engagement groove 8*a* with the second caster portion 10*b* facing downward. In this case, the convex portions 11*b* of the leg support attachment member 11 are engaged with the concave portions 8*b* with end surfaces of the convex portions 11*b* apart from bottom surfaces of the concave portions 8*b*.

After the leg pole 6 is sandwiched by the leg support main body 8 and the leg support attachment member 11, the two attachment bolts 13 are respectively inserted through the insertion holes 11*c* and respectively screwed into the screw holes 8*c* formed in the support main body 8. Thus, the support main body 8 and the leg support attachment member 11 are fastened with each other.

When the support main body 8 and the leg support attachment member 11 are fastened, one of the second side wall 6*d* of the leg pole 6 abuts the bottom surface 8*f* of the engagement groove 8*a* and the other second side wall 6*d* abuts the bottom surface 11*f* of the engagement groove 11*a*, and the leg pole 6 is pressed against by the front end portion 8*e* of the support main body 8 and the leg support attachment member 11 through abutting surfaces. Thus, the support main body 8 and the leg support attachment member 11, and thus the leg support 7, is orthogonally connected to the leg pole 6.

Figure 4A:
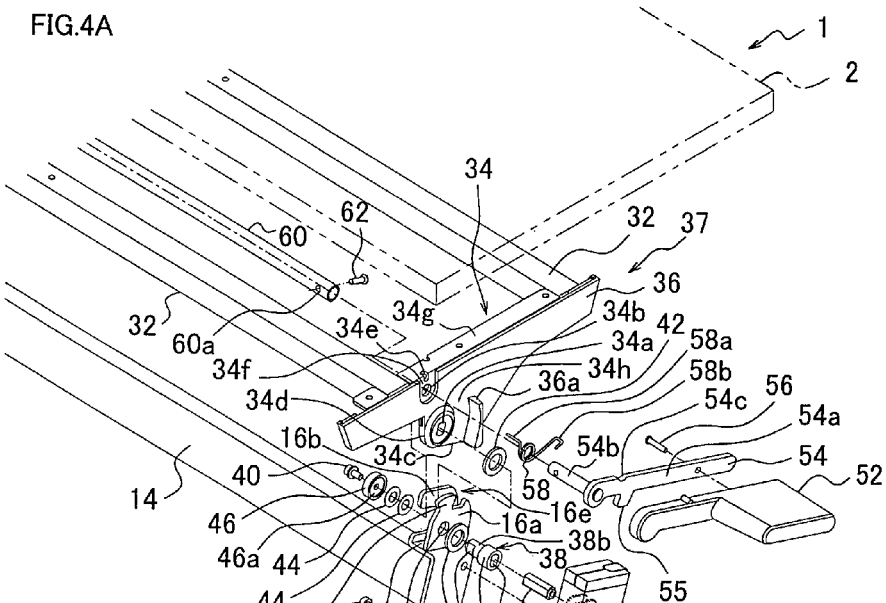
FIG. 4A is an exploded perspective view showing a detailed structure of the movable desk.

As shown in FIG. 1 and FIG. 4A, a frame pipe 14 is disposed in upper portions of the respective leg poles 6 for coupling the leg poles 6 with each other. A frame plate 16 is welded to each end of the frame pipe 14 so as to be perpendicular to a longitudinal direction of the frame pipe 14. The frame plate 16 is fastened to one of the second side walls 6*d* located on the inner side of the leg pole 6 by a bolt 18. Therefore, the frame pipe 14 is connected to the leg poles 6.

As shown in FIG. 4A, the frame plate 16 is a metal member including a plate-like frame pipe attachment portion 16*f* and a bearing portion 16*e*. The frame pipe 14 is welded to one surface of the frame plate 16, and the other surface of the frame plate 16 abuts and is connected to the second side wall 6*d* located on the inner side of the leg pole 6. The bearing portion 16*e* extends upward from the frame pipe attachment portion 16*f* and has an upwardly opened U-shaped cross section.

The bearing portion 16*e* includes a first plate portion 16*a* located on an outer side, a second plate portion 16*b* located on an inner side, and a bottom plate portion 16*c*. The first plate portion 16*a* and the second plate portion 16*b* are parallel with each other to form the upwardly opened U-shape. The bottom plate portion 16*c* is perpendicular to the first plate portion 16*a* and the second plate portion 16*b* and connects the first plate portion 16*a* and the second plate portion 16*b*. The bearing portion 16*e* supports a top panel support portion 30. The frame plate 16 is connected to the leg pole 6 such that the bottom plate portion 16*c* of the bearing portion 16*e* is perpendicular to the longitudinal direction of the leg pole 6.

The top panel support portion 30 includes a top panel connecting portion 37, a shaft portion 39, and a lock device 51.

The top panel connecting portion 37 includes two square pipes 32 made of metal, a pair of top panel receiving fittings 34, and covers 36 for covering the respective top panel receiving fittings 34. The square pipes 32 are disposed in the right and left direction under the top panel 2. The top panel receiving fittings 34 are disposed at respective both ends of the square pipes 32. The top panel connecting portion 37 is fixed to an undersurface of the top panel 2.

Each of the top panel receiving fittings 34, which is formed by perpendicularly bending a metal plate, includes a first flat portion 34*f* and a second flat portion 34*g*. When the second flat portion 34*g* is screwed to the undersurface of the top panel 2, the first flat portion 34*f* is located perpendicular to the top panel 2 and along the front and rear direction of the movable desk 1.

The first flat portion 34*f* is elongated along the front and rear direction of the top panel 2 and includes a protruding region 34*h* having a substantially trapezoidal configuration in a central part of the first flat portion 34*f*. The protruding region 34*h* includes an oval catch hole 34*a* in which a part of the shaft portion 39 is caught. The first flat portion 34*f* also includes an insertion hole 34*b* for attachment of the lock device 51. The insertion hole 34*b* is located closer to the top panel 2 and also closer to a front end of the top panel 2 than the catch hole 34*a*.

An insertion hole 34*e* is formed closer to the top panel 2 than the insertion hole 34*b* and in a corner connecting the first flat portion 34*f* and the second flat portion 34*g*. A part of the lock device 51 is inserted into the insertion hole 34*e*.

Respective one ends of the two square pipes 32 are welded to an inner surface of the first flat portion 34*f*, and thereby the right and left top panel receiving fittings 34 are coupled by the two square pipes 32.

Each of the covers 36, which is formed of synthetic resin into a configuration so as to cover an outer surface of the first flat portion 34*f* and side surfaces of the top panel receiving fitting 34, is attached to the top panel receiving fitting 34. The cover 36 includes cutouts in portions overlapping the catch hole 34*a*, the insertion hole 34*b*, and the insertion hole 34*e* so as to allow these holes to be exposed.

Figure 5B:
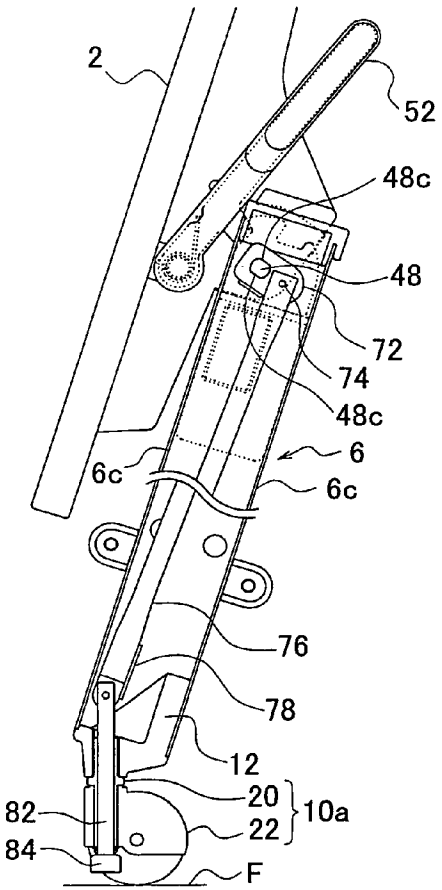
FIG. 5B is a side elevational view showing a state of the brake mechanism when the top panel is in the storage position.
Figure 5A:
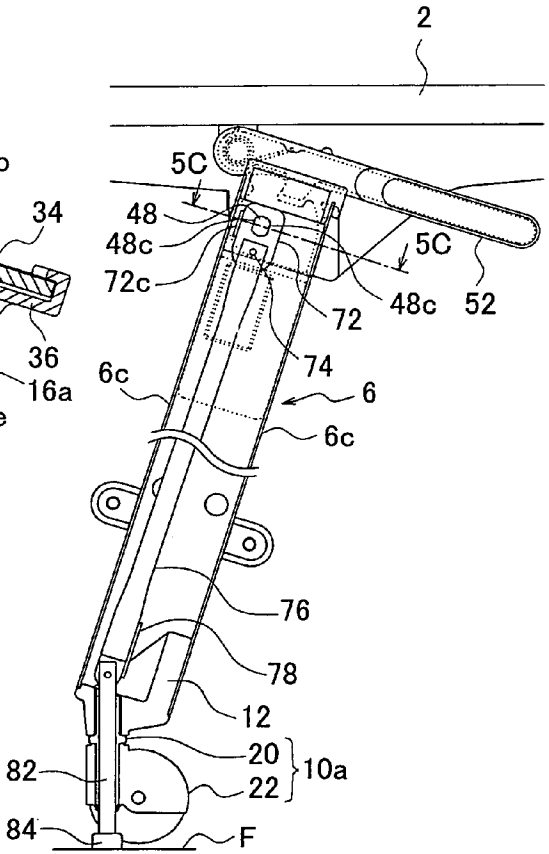
FIG. 5A is a side elevational view showing a state of the brake mechanism when the top panel is in the in-use position.
Figure 5C:
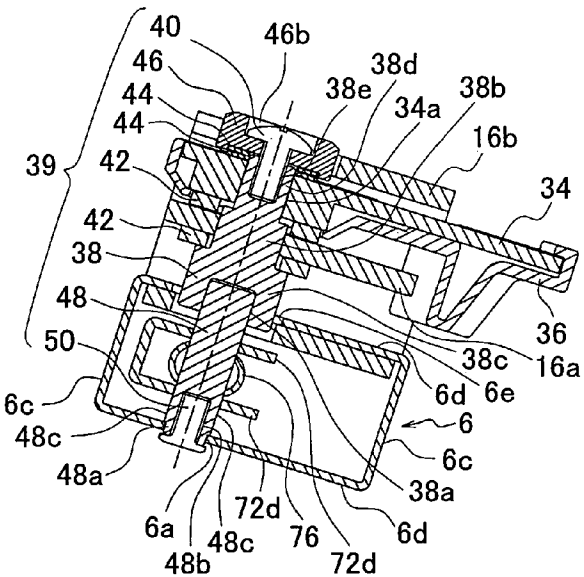
FIG. 5C is a cross sectional view taken along line 5C-5C in FIG. 5A showing a detailed structure of a shaft portion.

As shown in FIG. 4A and FIG. 5C, the shaft portion 39 includes a stepped rotary shaft 38, a rotary shaft fixing screw 40, disk springs 44, a disk spring fixing member 46, a cam shaft 48, a cam shaft fixing screw 50, and washers 42. When the shaft portion 39 is joined to the top panel connecting portion 37, the shaft portion 39 is rotatably supported by the leg pole 6 (specifically the bearing portion 16*e* of the frame plate 16 fixed to the leg pole 6) around a horizontal axis in the right and left direction. The shaft portion 39 is rotated following a rotation of the top panel 2.

The stepped rotary shaft 38 is a cylindrical rod-like member having different diameters along the stepped rotary shaft 38. Specifically, the stepped rotary shaft 38 includes a smaller cylindrical portion 38*b* and a larger cylindrical portion 38*c* having a larger diameter than the smaller cylindrical portion 38*b*.

An oval shaft portion 38*d* having an oval cross section is formed at an open end of the smaller cylindrical portion 38*b*.

An end portion of the oval shaft portion 38*d* includes a screw hole 38*e* into which the rotary shaft fixing screw 40 is screwable. An end portion of the larger cylindrical portion 38*c* includes an oval catch hole 38*a* with which the cam shaft 48 is engageable.

The cam shaft 48 is a rod-like member having an oval cross section with one end portion 48*a* having a cylindrical configuration slightly smaller than the remaining part. The end portion 48*a* includes a screw hole 48*b* into which the cam shaft fixing screw 50 is screwable.

The disk spring fixing member 46 having a circular, thin plate configuration includes an opening portion 46*a* having such a diameter as to be engageable with the disk springs 44 in one plate surface. The disk spring fixing member 46 also includes a counterbore 46*b* receivable of a head of the rotary shaft fixing screw 40 in the other plate surface.

In the bearing portion 16*e* extending upward in the frame plate 16, the first plate portion 16*a* includes a round insertion hole 16*d* in which the smaller cylindrical portion 38*b* of the stepped rotary shaft 38 is slidingly rotatable. The smaller cylindrical portion 38*b* of the stepped rotary shaft 38 is inserted from an outer side of the first plate portion 16*a* through the washer 42.

In an inner side of the first plate portion 16*a*, a washer 42 is first inserted around the smaller cylindrical portion 38*b*. Subsequently, the oval shaft portion 38*d* formed at the end of the smaller cylindrical portion 38*b* is engaged with the oval catch hole 34*a* formed in the top panel receiving fitting 34. In addition, the disk spring fixing member 46 having the opening portion 46*a* engaged with the two disk springs 44 is inserted. Then, the rotary shaft fixing screw 40 is screwed into the screw hole 38*e* provided at the end surface of the oval shaft portion 38*d* of the stepped rotary shaft 38. Thus, the stepped rotary shaft 38 is rotatably connected to the first plate portion 16*a*.

Since the top panel receiving fitting 34 is engaged with the stepped rotary shaft 38 through the catch hole 34*a*, the top panel 2 is rotated integrally with the rotation of the stepped rotary shaft 38 through the top panel receiving fitting 34.

As shown in FIG. 5C, each component attached from an inner side of the first plate portion 16*a* and the top panel receiving fitting 34 are located between the first plate portion 16*a* and the second plate portion 16*b* of the bearing portion 16*e*.

When the bottom plate portion 16*c* abuts a lower end surface 34*c* of the protruding region 34*h* of the top panel receiving fitting 34, the top panel 2 is positioned in the substantially horizontal in-use position. When the bottom plate portion 16*c* abuts a front end surface 34*d* of the protruding region 34*h* of the top panel receiving fitting 34, the top panel 2 is positioned in the substantially vertical storage position.

The cover 36 includes a wall portion 36*a* which protrudes from a surface of the cover 36 covering the first flat portion 34*f* on a rear side of the catch hole 34*a*. The wall portion 36*a* has a configuration along a rear side surface of the first plate portion 16*a* and is located in a rear of the first plate portion 16*a* when the top panel 2 is in the in-use position.

Since the disk springs 44 are inserted between the stepped rotary shaft 38 and the rotary shaft fixing screw 40, the top panel receiving fitting 34 is constantly biased by a bias force toward the first plate portion 16*a* by the disk springs 44. Since the bias force causes friction between the first plate portion 16*a* and the washer 42, a rotating speed of the top panel receiving fitting 34 and thus of the top panel 2 can be suppressed.

As described above, the disk spring fixing member 46 includes the opening portion 46*a* engageable with the disk springs 44. Since the disk springs 44 engaged with the opening portion 46*a* are inserted around the stepped rotary shaft 38, and then the rotary shaft fixing screw 40 is screwed with the disk springs 44, it is possible to suppress the disk springs 44 from coming off while the rotary shaft fixing screw 40 is being connected to the stepped rotary shaft 38. It is also possible to suppress centers of the disk springs 44 from being deviated from a center of the rotary shaft fixing screw 40. Accordingly, the connecting operation of the rotary shaft fixing screw 40 can easily be performed.

The cam shaft 48 is engaged with the oval catch hole 38*a* formed in an end portion of the larger cylindrical portion 38*c* of the stepped rotary shaft 38. Upper portions of the pair of second side walls 6*d* of the leg pole 6 includes insertion holes 6*e*, 6*a* through which the cam shaft 48 is insertable from an inner side to an outer side, and thereby the cam shaft 48 is arranged so as to pass through an inside of the leg pole 6. The cylindrical end portion 48*a* of the cam shaft 48 is inserted into the insertion hole 6*a* formed in an outer second side wall 6*d* of the leg pole 6. When the shaft fixing screw 50, with a screw head having a larger diameter than the insertion hole 6*a*, is screwed into the end portion 48*a* through the insertion hole 6*a* from an outer side of the leg pole 6, the cam shaft 48 is pivotably held by the leg pole 6.

The frame plate 16 is detachably attached to the second side wall 6*d* by the bolt 18, and the shaft portion 39 is constituted by the cam shaft 48, to which the cam 72 is fixed, and the stepped rotary shaft 38 to be inserted through the insertion hole 16*d* of the bearing portion 16*e* provided in the frame plate 16, connected with each other. Accordingly, it may be possible to assemble the leg 4 including the brake mechanism 70 therewithin and other components (e.g., the top panel 2 and the top panel support portions 30) independently.

Figure 6B:
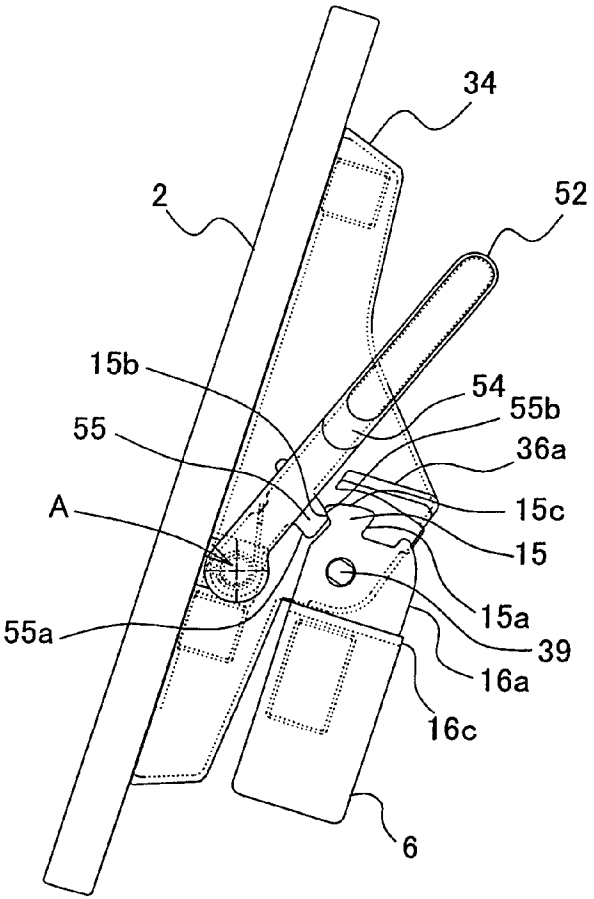
FIG. 6B is a side elevational view showing a state of a lock device when the top panel is in the storage position.
Figure 6A:
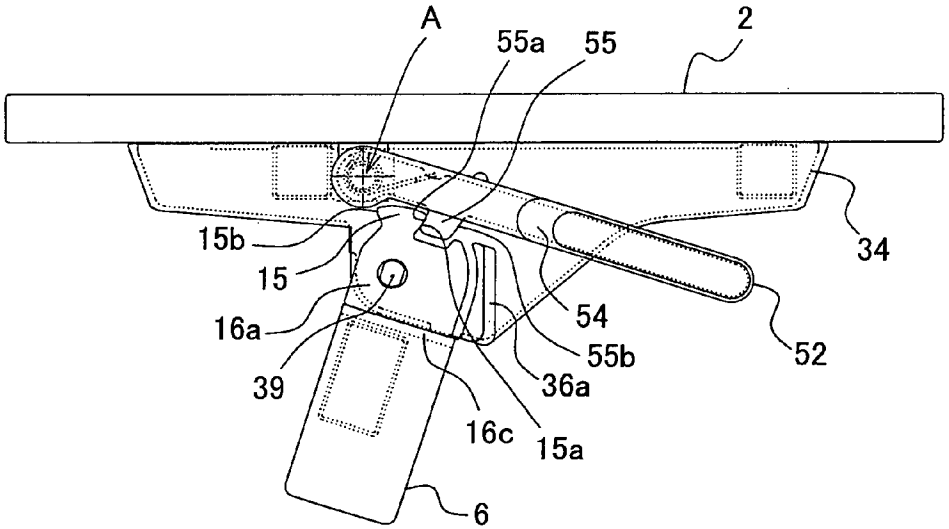
FIG. 6A is a side elevational view showing a state of a lock device when the top panel is in the in-use position.

A description of the lock device 51 will now be provided below. As shown in FIG. 4A, FIG. 6A and FIG. 6B, the lock device 51 including an operation lever 52, a lock member 54, and a coil spring 58 is provided under the top panel 2. A receiving portion 15 is provided in an upper end of the first plate portion 16*a* of the bearing portion 16*e* so as to protrude upward. Once the lock member 54 is engaged with the receiving portion 15, the top panel 2 is secured in each of the in-use position and the storage position so as not to be rotated by an external force.

The lock member 54 includes a plate-like lock main body 54*a* having an elongated elliptical configuration and a rod-like connecting portion 54*b* provided at one end of the lock main body 54*a* so as to be perpendicular to a plate surface of the lock main body 54*a*. The operation lever 52 is connected to the lock main body 54*a* by a screw 56.

The lock member 54, with the coil spring 58 inserted around the connecting portion 54*b*, is inserted through the insertion hole 34*b* in one of the pair of top panel receiving fittings 34, e.g., the right top panel receiving fitting 34, from the outer side. The connecting portion 54*b* is subsequently fixed by a screw to an end portion 60*a* of an interlock pipe 60 extending in the right and left direction under the top panel 2.

A connecting portion 54*b* of another lock member 54 projecting from through the left top panel receiving fitting 34 is fixed to a left end portion (not shown) of the interlock pipe 60. The lock members 54 on both right and left sides are supported by the respective right and left top panel receiving fittings 34 such that the lock members 54 are interlockingly rotatable around the axes of the respective connecting portions 54*b*.

In the coil spring 58 inserted around the connecting portion 54*b*, a first end portion 58*a* of the coil spring 58 extending in an axial direction of the coil spring 58 is inserted into the insertion hole 34*e* of the top panel receiving fitting 34. At the same time a second end portion 58*b* located at an opposite end of the coil spring 58 and having a hook-like configuration is engaged with a dent 54*c* formed in an upper side surface of the lock main body 54*a*. Accordingly, the lock member 54 is constantly biased toward the receiving portion 15.

An engaging portion 55 to be engaged with the receiving portion 15 protrudes from a lower side surface of the lock main body 54*a* in a vicinity of the connecting portion 54*b*. The first plate portion 16*a* of the bearing portion 16*e* and the lock member 54 (and thus the receiving portion 15 and the engaging portion 55) are located on a same plane perpendicular to the top panel 2. Accordingly, the receiving portion 15 constantly abuts the engaging portion 55 when the operation lever 52 is not operated. In the following description, a rotation axis of the lock member 54 is an A axis.

As shown in FIG. 6A, when the top panel 2 is in the in-use position, a part of a first engaged surface 15*a* defining a rear surface of the receiving portion 15 and a part of a first engaging surface 55*a* defining a surface of the engaging portion 55 on the A axis side engage with each other, thereby preventing rotation of the top panel 2. As shown in FIG. 6B, when the top panel 2 is in the storage position, a part of a second engaged surface 15*b* defining a front surface of the receiving portion 15 and a part of a second engaging surface 55*b* defining a surface of the engaging portion 55 on a side facing opposite to the A axis engage with each other, thereby preventing rotation of the top panel 2.

Figure 7A:
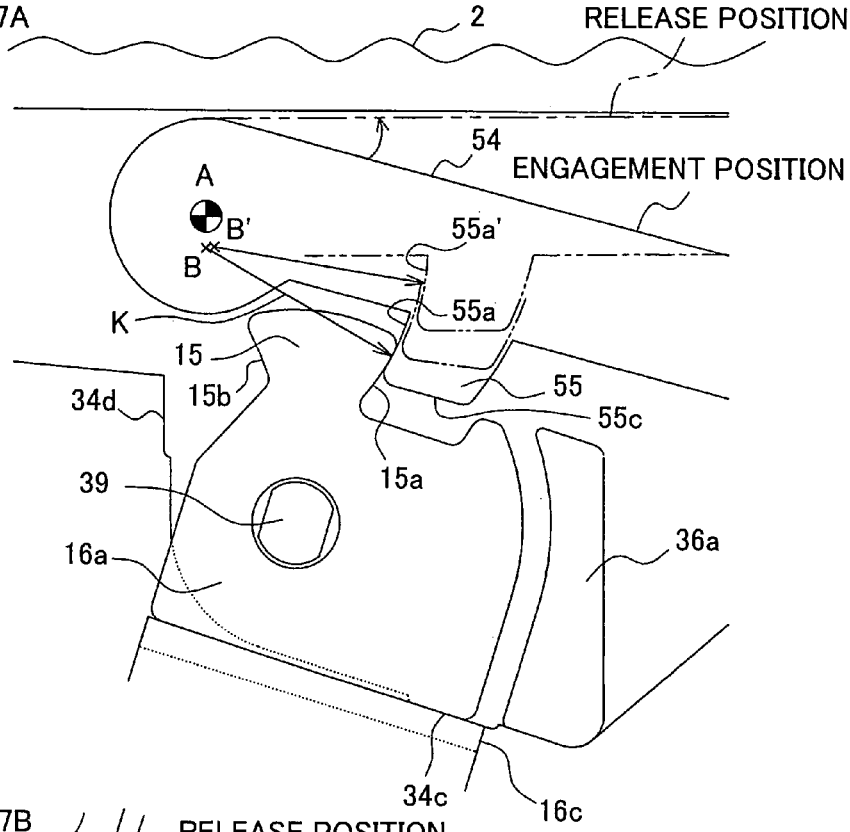
FIG. 7A is a side elevational view showing an engaging state of a receiving portion and an engaging portion when the top panel is in the in-use position.

As shown in FIG. 7A, the first engaged surface 15*a* and the first engaging surface 55*a* have respective circular arc configurations with a same diameter around a B axis which is parallel to the A axis, and is located slightly below the A axis. Accordingly, when the top panel 2 is positioned in the in-use position, and thereby the lock member 54 is in an engagement position where the receiving portion 15 and the engaging portion 55 are engaged with each other, the first engaged surface 15*a* and the first engaging surface 55*a* mate with each other.

Figure 7B:
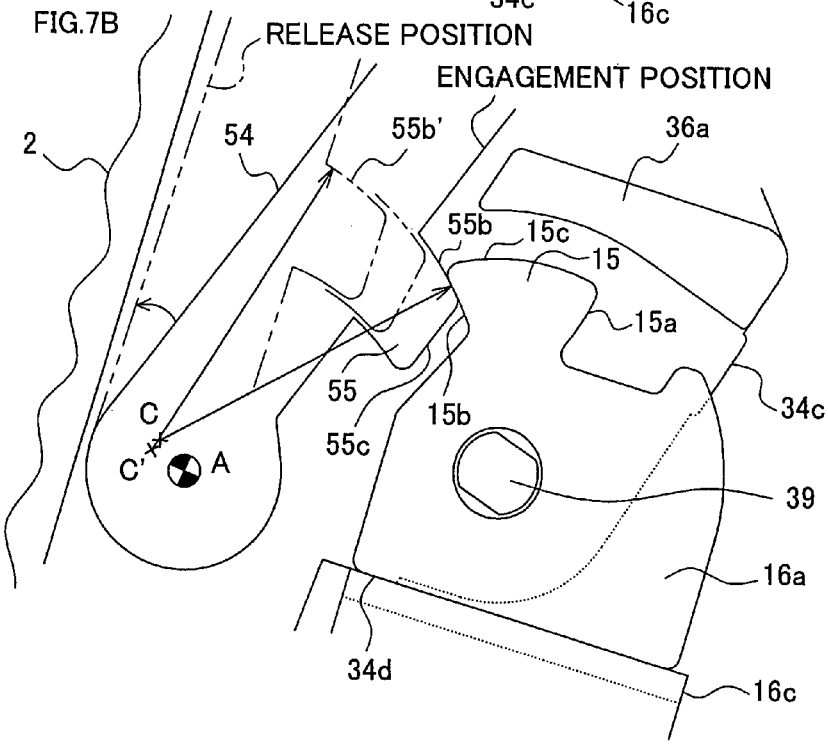
FIG. 7B is a side elevational view showing an engaging state of a receiving portion and an engaging portion when the top panel is in the storage position.

As shown in FIG. 7B, the second engaged surface 15*b* and the second engaging surface 55*b* have respective circular arc configurations with a same diameter around a C axis which is parallel to the A axis, and is located forward of and obliquely above the A axis. Accordingly, when the top panel 2 is positioned in the storage position, and thereby the lock member 54 is in an engagement position where the receiving portion 15 and the engaging portion 55 are engaged with each other, the second engaged surface 15*b* and the second engaging surface 55*b* mate with each other.

Figure 4B:
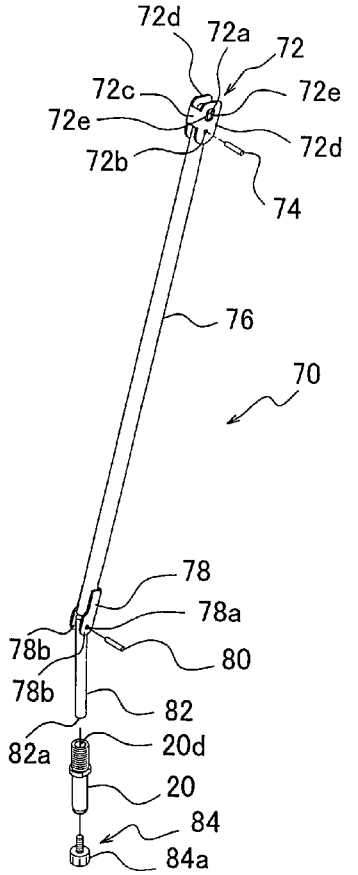
FIG. 4B is an exploded perspective view showing a structure of a brake mechanism.

A description of the brake mechanisms 70 will now be provided. As shown in FIG. 4B, each of the brake mechanisms 70 includes a cam 72, a synchronization rod 76, a stopper rod 82, a stopper 84, and a hollow shaft member 20.

The cam 72 is a U-shaped cross-sectional member formed by bending a metal plate. The cam 72 includes a pair of parallel flat portions 72*d* each having a substantially rectangular configuration. Each of the flat portions 72*d* has an oval engagement hole 72*a* engageable with the cam shaft 48 and a pin hole 72*b*. The oval engagement hole 72*a* and the pin hole 72*b* are arranged along a longitudinal direction of each of the flat portions 72*d*, and penetrate the parallel flat portion 72*d*. When the cam shaft 48 is inserted through the engagement hole 72*a* formed in each of the flat portion 72*d*, the cam 72 is integrally rotatable with the cam shaft 48.

The oval engagement hole 72*a* includes a pair of parallel sides 72*e* which are oriented parallel to a base portion 72*c* connecting the pair of flat portions 72*d*. When the top panel 2 is in a substantially horizontal in-use position, a pair of parallel surfaces 48*c* of the oval cam shaft 48 are located parallel to the first side wall 6*c* of the leg pole 6 (see FIG. 5A and FIG. 5C).

The synchronization rod 76, which is a rod-like member having substantially a same length as the leg pole 6, is disposed inside the leg pole 6 in the upper and lower direction. The synchronization rod 76 includes an upper end portion having insertion holes (not shown) formed in a direction perpendicular to an axis of the synchronization rod 76. The synchronization rod 76 includes a lower end portion to which a connection fitting 78 is welded. When the upper end portion of the synchronization rod 76 is disposed between the pair of flat portions 72*d* of the cam 72 and a pin 74 is inserted through the pin holes 72*b* and the insertion holes, the synchronization rod 76 is supported by a pin 74 in a swingable manner with respect to the cam 72.

The connection fitting 78 is a U-shaped cross sectional member formed by bending a metal plate. The connection fitting 78 is welded to the synchronization rod 76 such that three surfaces of the connection fitting 78 fittingly abut the rod-like synchronization rod 76 and a lower end of the connection fitting 78 extends from the lower end portion of the synchronization rod 76. The connection fitting 78 includes a pair of parallel flat portions 78*b* defining protruding portions of the connection fitting 78. Each of the pair of parallel flat portions 78*b* includes a pin hole 78*a* penetrating therethrough.

The stopper rod 82 is a rod-like member having such a diameter that the stopper rod 82 can pass through the later-described hollow shaft member 20. The stopper rod 82 includes an upper end portion having insertion holes (not shown) formed in a direction perpendicular to an axis of the stopper rod 82. The stopper rod 82 includes a lower end portion 82*a* having a screw hole (not shown) into which the stopper 84 is screwable. When the insertion holes (not shown) formed in the upper end portion of the stopper rod 82 are disposed between the pair of flat portions 78*b* of the connection fitting 78 and a pin 80 is inserted through the pin holes 78*b* and the insertion holes (not shown), the stopper rod 82 is supported by the pin 80 in a swingable manner with respect to the connection fitting 78 and thus to the synchronization rod 76. In this state, the stopper rod 82 projects from a lower end of the leg pole 6.

The first caster portion 10*a* including the hollow shaft member 20 will be described below. The first caster portion 10*a*, including the hollow shaft member 20 and the caster main body 22, is connectable to the lower end of the leg pole 6 through a caster attachment member 12.

The caster attachment member 12 includes an attachment portion 12*a* and an engagement portion 12*b*. The attachment portion 12*a* includes a screw hole 12*c* into which the hollow shaft member 20 is screwable. The engagement portion 12*b* projecting upward above the attachment portion 12*a* is engageable with a lower end portion of the leg pole 6. The screw hole 12*c*, into which the hollow shaft member 20 is screwed, is formed so as to be perpendicular to the floor surface F when the caster attachment member 12 is engaged with the leg pole 6.

The caster main body 22 includes a pair of wheels 22*a* and a tubular portion 22*b* provided between the pair of wheels 22*a*. The tubular portion 22*b* is configured to receive the hollow shaft member 20.

The hollow shaft member 20 is a tubular member including a hollow portion 20*d* through which the stopper rod 82 is insertable and a flange 20*a* formed in an axially central area of the hollow shaft member 20. A configuration of an upper part of the hollow shaft member 20 above the flange 20*a* is different from a configuration of a lower part of the hollow shaft member 20 below the flange 20*a*. The upper part above the flange 20*a* is a screw portion 20*b* which is screwable into the screw hole 12*c* formed in the caster attachment member 12. The lower part below the flange 20*a* is a rod-like portion 20*c* which is insertable into the tubular portion 22*b* of the caster main body 22. The first caster portion 10*a* is constituted by inserting the rod-like portion 20*c* into the tubular portion 22*b* of the caster main body 22, and thereby connecting the caster main body 22 to the hollow shaft member 20 so as to be rotatable around the rod-like portion 20*c* as a rotation shaft.

The first caster portion 10*a* constituted as above, is integrated with the caster attachment member 12 by screwing the screw portion 20*b* of the hollow shaft member 20 into the screw hole 12*c* of the caster attachment member 12. While the stopper rod 82 projecting from the lower end of the leg pole 6 is inserted through the hollow portion 20*d* of the hollow shaft member 20, the engagement portion 12*b* of the caster attachment member 12 is engaged with the lower end of the leg pole 6. Then, screws 71 are screwed from the rear of the leg pole 6 into screw holes 12*d* formed in the engagement portion 12*b*, and thereby the engagement portion 12*b* is secured to the leg pole 6. Thus, the first caster portion 10*a* is secured to the lower end of the leg pole 6.

The stopper 84 is a bolt screwable into a screw hole formed in an end of the stopper rod 82. A screw head of the bolt is a synthetic resin member 84*a* having a disk-like configuration sized to have a diameter larger than an outer diameter of the rod-like portion 20*c* of the hollow shaft member 20 and to be upwardly and downwardly movable between the two wheels 22*a*. The stopper 84 is screwed into the screw hole formed in the end of the stopper rod 82 projecting from under the first caster portion 10*a* through the hollow shaft member 20. The stopper 84 is configured such that a screwing amount into the screw hole of the stopper rod 82 is adjustable by manually rotating. By adjusting the screwing amount, a height of the lower end of the leg pole 6 from the floor surface F can be appropriately adjusted.

A description of an operation of the movable desk 1 in use will now be provided. In FIG. 5A, FIG. 5B, FIG. 6A and FIG. 6B, components constituting the movable desk 1 are shown partially in phantom for explanation purposes.

In the movable desk 1 of the present embodiment, when the top panel 2 is in the substantially horizontal in-use position, as shown in FIG. 5A, the cam 72 is located such that the base portion 72*c* is parallel to the first side walls 6*c* of the leg pole 6. The pin 74 serving as a connecting point with the synchronization rod 76 is located below a rotation center of the cam 72, i.e., the cam shaft 48. In this case, the synchronization rod 76 is located at a lowest position inside the leg pole 6, and the stopper 84 contacts the floor surface F, while the first caster portion 10*a* is separated from the floor surface F. Accordingly, the movable desk 1 is secured so as not to move when the top panel 2 is in the in-use position.

To rotate the top panel 2 to the substantially vertical storage position (a position forming an angle of approximately 80 degrees between the top panel 2 and the floor surface F in the present embodiment) as shown in FIG. 5B and FIG. 6B, the operation lever 52 is first rotated toward the top panel 2. When the operation lever 52 is rotated toward the top panel 2, the lock member 54 is rotated from the engagement position toward a release position, and the first engaging surface 55*a* is rotated to move in a direction of departing from the first engaged surface 15*a*. Specifically, since the B axis is below the A axis, a central axis of the first engaging surface 55*a* is shifted rearward from the B axis, in accordance with a rotation of the lock member 54 in a counterclockwise direction around the A axis. That is, the central axis of the first engaging surface 55*a* is shifted to a B' axis closer to the first engaged surface 15*a* than the B axis.

Accordingly, while the central axis of the first engaged surface 15*a* remains the B axis, the central axis of the first engaging surface 55*a* is shifted from the B axis to the B' axis in accordance with the rotation of the lock member 54. As a result, the first engaging surface 55*a* is rotated to move in a direction of departing from the first engaged surface 15*a* to a position of a first engaging surface 55*a*'. Thus, an engagement between the first engaged surface 15*a* and the first engaging surface 55*a* is released.

When the top panel 2 is pushed upward to be rotated toward the storage position while the engagement between the first engaged surface 15*a* and the first engaging surface 55*a* is released, the cam 72 is rotated with the top panel 2 in a counterclockwise direction, as shown in FIG. 5B. At the same time, the position of the pin 74 as the connecting point with the synchronization rod 76 is also rotated to be located obliquely right below the rotation center of the cam 72, i.e., the cam shaft 48.

At this time, the synchronization rod 76 is moved from the lowest position to a highest position inside the leg pole 6, and the stopper rod 82 inserted through the hollow portion 20*d* of the hollow shaft member 20 is moved vertically upward in a sliding manner inside the hollow portion 20*d*.

Accordingly, the stopper 84 provided at a lower end of the stopper rod 82 is also moved vertically upward to be separated from the floor surface F, while the first caster portion 10*a* is brought into contact with the floor surface F. Thus, when the top panel 2 is in the storage position, the movable desk 1 is movable with the first caster portion 10*a* which has become in contact with the floor surface F and with the rear-located second caster portion 10*b* which is constantly in contact with the floor surface F.

Figure 8A:
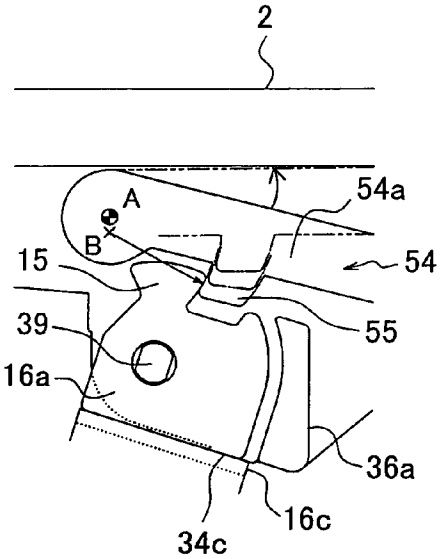
FIG. 8A is a side elevational view showing a positional relationship between the receiving portion and the engaging portion of a lock device when the top panel is in the in-use position.
Figure 8B:
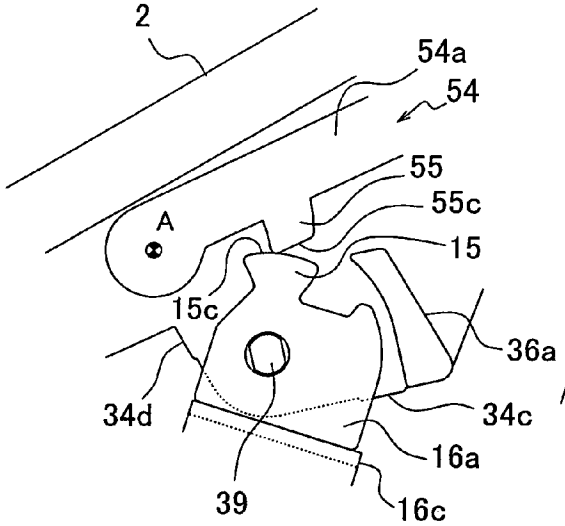
FIG. 8B is a side elevational view showing a positional relationship between the receiving portion and the engaging portion of the lock device when the top panel is in between the in-use position and the storage position.

The lock member 54 is constantly biased by the coil spring 56 in a direction of abutting the receiving portion 15. Accordingly, when a hand is removed from the operation lever 52 while the top panel 2 is rotated from the in-use position to the storage position, a part of an end surface 55*c* of the engaging portion 55 abuts an upper end surface 15*c* of the receiving portion 15, as shown in FIG. 8B. The part of the end surface 55*c* is slid on the upper end surface 15*c* in accordance with the rotation of the top panel 2.

Figure 8C:
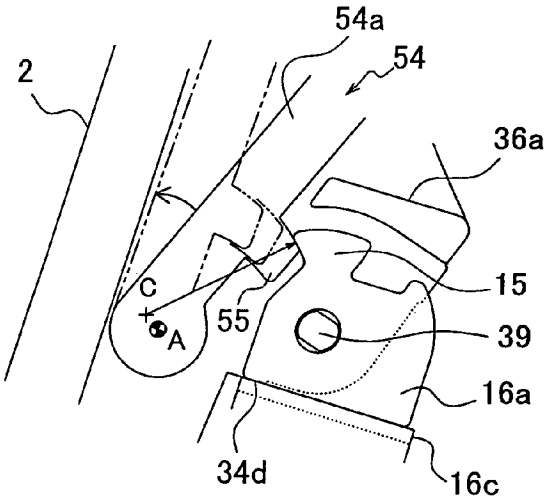
FIG. 8C is a side elevational view showing a positional relationship between the receiving portion and the engaging portion of the lock device when the top panel is in the storage position.

When the top panel 2 is further rotated, the front end surface 34*d* of the top panel receiving fitting 34 abuts the bottom plate portion 16*c* of the bearing portion 16*e*, as shown in FIG. 8C. Then, the top panel 2 is positioned in the storage position, and the engaging portion 55 is moved to a forward of the receiving portion 15 so that the part of the second engaged surface 15*b* and the part of the second engaging surface 55*b* engage with each other, as shown in FIG. 7B and FIG. 8C. In this case, the wall portion 36*a* provided in the cover 36 is moved to be located above the receiving portion 15 in accordance with the rotation of the top panel 2. The wall portion 36*a*, therefore, remains located above the receiving portion 15 when the top panel 2 is in the storage position.

To rotate the top panel 2 from the storage position to the in-use position as shown in FIG. 7B and FIG. 8C, the operation lever 52 is first rotated toward the top panel 2. When the operation lever 52 is rotated toward the top panel 2, the lock member 54 is rotated from the engagement position to the release position, and thereby the second engaging surface 55*b* is rotated to move in a direction of departing from the second engaged surface 15*b*. Specifically, since the C axis is obliquely above forward of the A axis, a central axis of the second engaging surface 55*b* is shifted downward from the C axis, that is, shifted to a C' axis more distant from the second engaged surface 15*b* than the C axis, in accordance with a rotation of the lock member 54 in a counterclockwise direction around the A axis.

Accordingly, while the central axis of the second engaged surface 15*b* remains the C axis, the central axis of the second engaging surface 55*b* is shifted from the C axis to the C' axis in accordance with the rotation of the lock member 54. As a result, the second engaging surface 55*b* is rotated to move in a direction of departing from the second engaged surface 15*b* to a position of a second engaging surface 55*b*'. Thus an engagement between the second engaged surface 15*b* and the second engaging surface 55*b* is released.

When the top panel 2 is pushed downward to be rotated toward the in-use position while the engagement between the second engaged surface 15*b* and the second engaging surface 55*b* is released, the cam 72 is rotated with the top panel 2 in a clockwise direction. As shown in FIG. 5A, the pin 74 is moved to be located again below the rotation center of the cam 72, i.e., the cam shaft 48.

At this time, the synchronization rod 76 is moved downward, and the stopper rod 82 inserted through the hollow portion 20*d* of the hollow shaft member 20 is moved vertically downward in a sliding manner inside the hollow portion 20*d*. Then, the stopper 84 is brought into contact with the floor surface F. In the movable desk 1, the stopper 84 is brought into contact with the floor surface F in the middle of the rotation of the top panel 2 to the in-use position.

When the rotation of the top panel 2 proceeds further, the cam 72 is pushed upward through the stopper rod 82 and the synchronization rod 76 due to a repulsive force from the floor surface F on the stopper 84. When the cam 72 is pushed upward, the cam shaft 48 connected to the cam 72 and a shaft portion 39 including the cam shaft 48 are pushed upward. As a result, the leg pole 6 connected to the shaft portion 39 is pushed upward. Thus, the first caster portion 10*a* is separated from the floor surface F.

When a hand is removed from the operation lever 52 while the top panel 2 is rotated from the storage position to the in-use position, the part of the end surface 55*c* is slid on the upper end surface 15*c*, as shown in FIG. 8B, in a same manner as in the case where the top panel 2 is rotated from the in-use position to the storage position. When the top panel 2 is further rotated, the lower end surface 34*c* of the top panel receiving fitting 34 abuts the bottom plate portion 16*c* of the bearing portion 16*e*. Then, the top panel 2 is positioned in the in-use position, and the engaging portion 55 is moved rearward of the receiving portion 15 so that the part of the first engaged surface 15*a* and the part of the second engaging surface 55*a* engage with each other, as shown in FIG. 7A and FIG. 8A.

A description of an adjusting mechanism (hereinafter referred to as a "height adjusting device") provided in the rear end portion 8*h* of the leg support main body 8 in order to adjust a height of the rear end portion 8*h* of the leg support main body 8 from the floor surface F will now be provided with reference to FIG. 9 and FIGS. 10A to 10C. FIGS. 10A to 10C are cross sectional views of the rear end portion 8*h* of the leg support main body 8 taken along a plane, which passes through a center of the adjuster 21 and is parallel to a longitudinal direction of the leg support main body 8.

Figure 9:
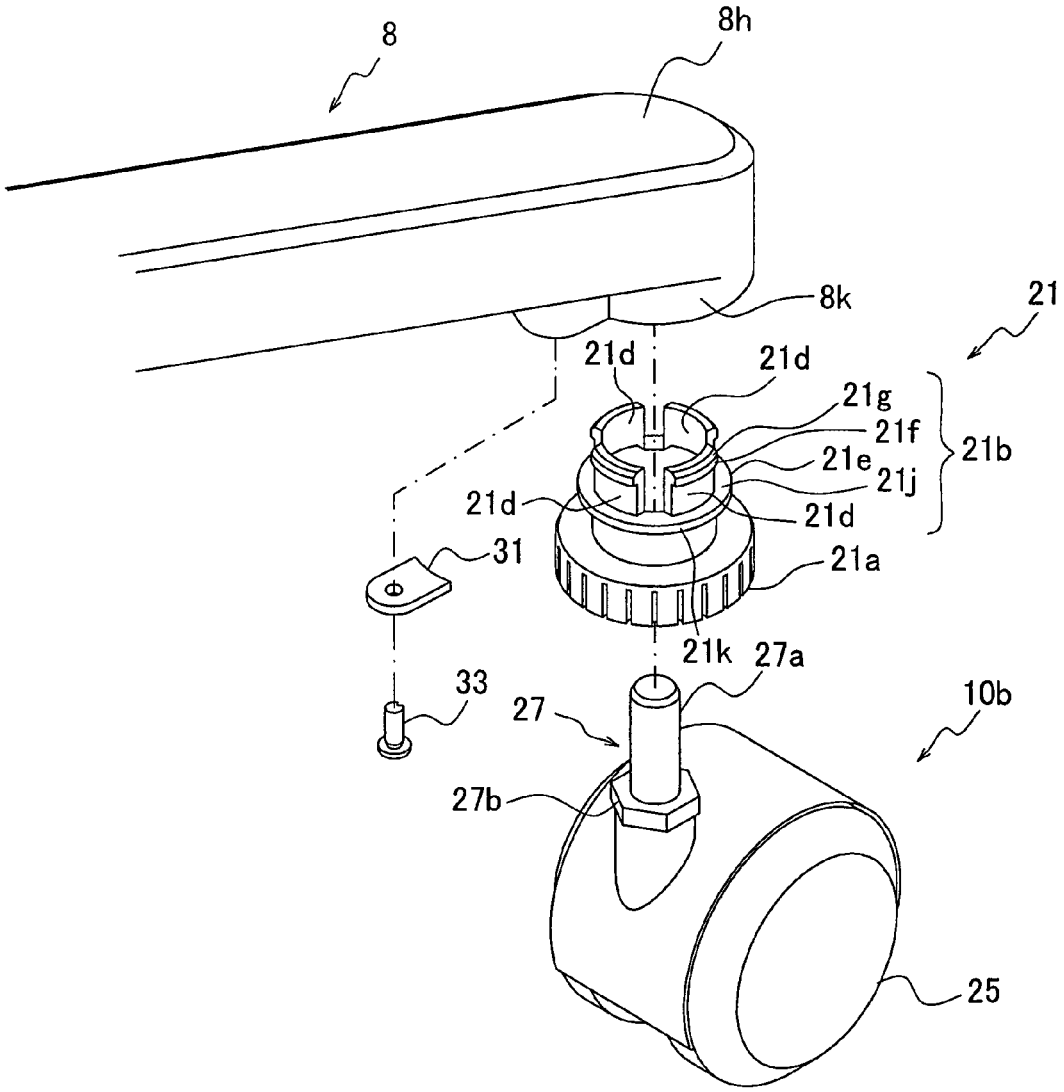
FIG. 9 is an enlarged exploded perspective view of a circled area 9 in FIG. 1 showing a structure of a height adjusting device.
Figures 10A, 10B, 10C:
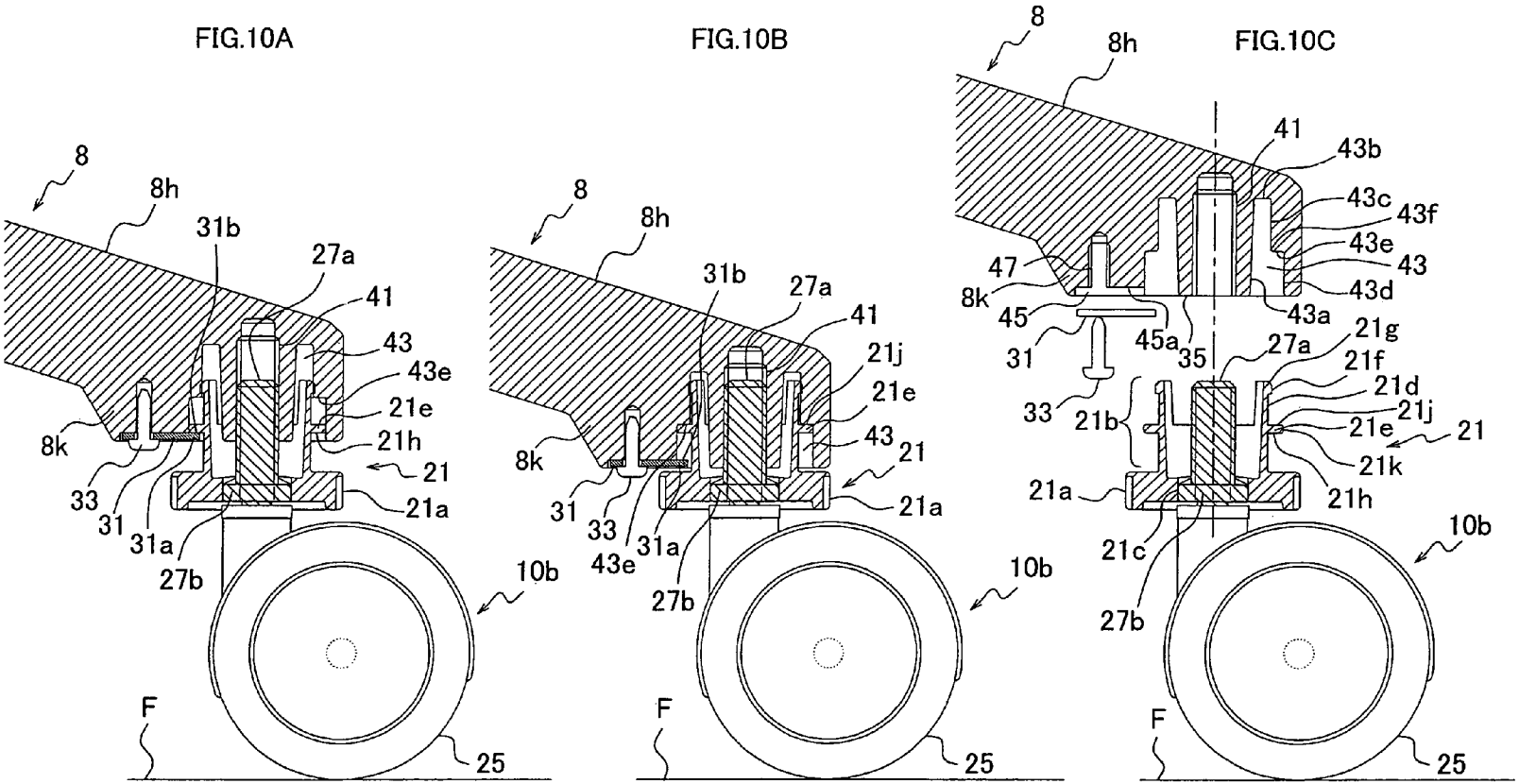
FIG. 10A is a cross sectional view showing the structure of the height adjusting device in FIG. 9 when a lower end of the leg support main body is located at a highest position.
FIG. 10B is a cross sectional view showing the structure of the height adjusting device in FIG. 9 when the lower end of the leg support main body is located at a lowest position.
FIG. 10C is an exploded cross sectional view showing the structure of the height adjusting device in FIG. 9.
Figure 11:
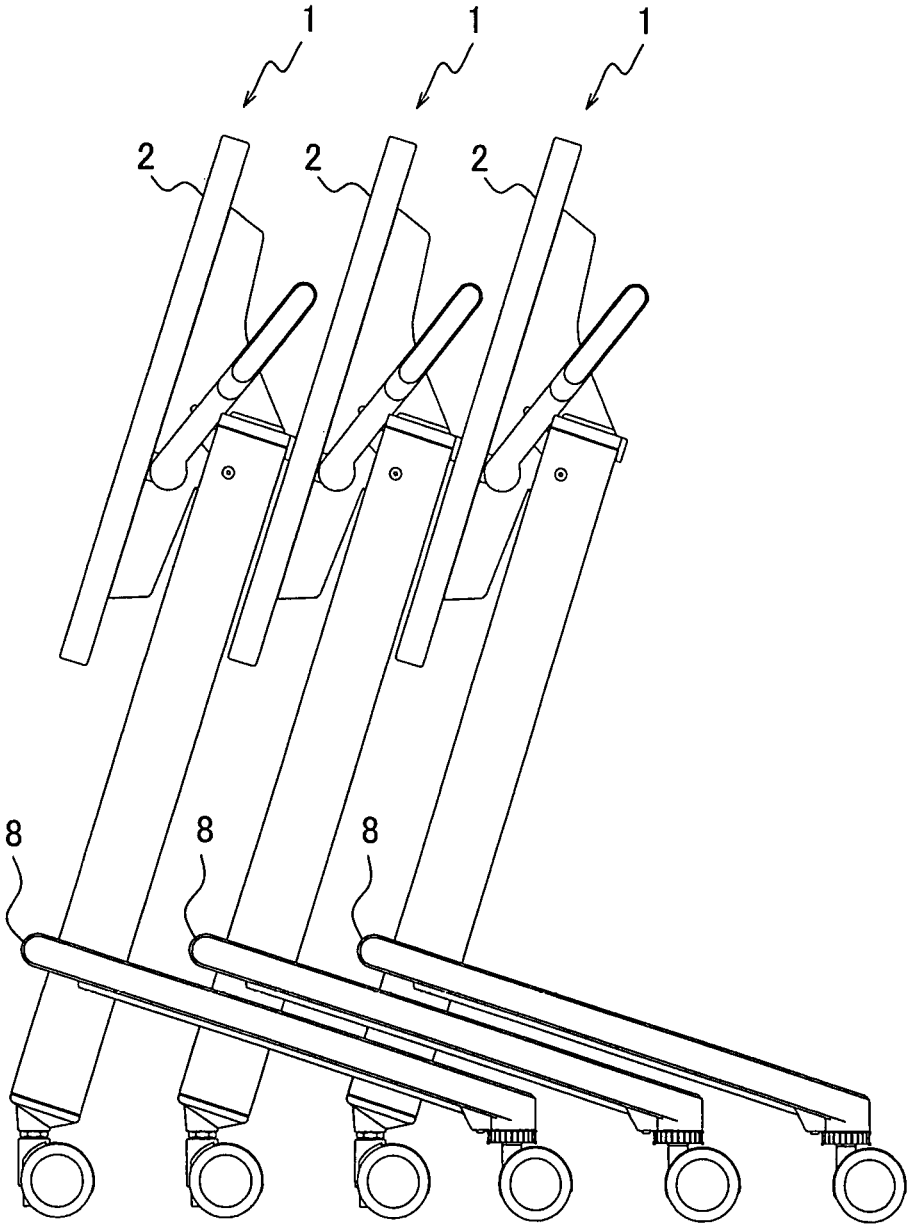
FIG. 11 is an appearance view showing a state in which a plurality of movable desks are stacked in a front and rear direction.

As shown in FIG. 9, the height adjusting device includes the second caster portion 10*b*, an adjuster 21, and a thin plate-like adjuster lock member 31, and a fixing screw 33. The adjuster lock member 31 is provided in order to prevent the second caster portion 10*b* from being detached from the leg support main body 8. The fixing screw 33 is provided to fix the adjuster lock member 31 to the leg support main body 8.

The second caster portion 10*b* includes a caster main body 25 and an attachment portion 27 for attachment to the leg support main body 8. The attachment portion 27 upwardly projects from the caster main body 25 in a pivotable manner with respect to the caster main body 25. The attachment portion 27 includes an attachment bolt 27*a* for attaching the caster main body 25 to the leg support main body 8 and an adjuster engagement portion 27*b*. The adjuster engagement portion 27*b* having a hexagonal flange-like configuration is provided at a base of the attachment bolt 27*a* in order to fix the adjuster 21.

The adjuster 21 formed of synthetic resin includes a flange-like operation portion 21*a* and a brake portion 21*b*. The operation portion 21*a* is externally operable. The brake portion 21*b* upwardly projects from the operation portion 21*a* in a cylindrical configuration and is inserted into the leg support main body 8.

The operation portion 21*a* has a disk-like configuration having a diameter larger than a diameter of the brake portion 21*b*. The operation portion 21*a* includes an engagement hole 21*c* in a central part thereof. The engagement hole 21*c* is insertable around the attachment bolt 27*a* and also engageable with the hexagonal adjuster engagement portion 27*b*.

The brake portion 21*b* has a substantially cylindrical configuration such that a side wall gradually becomes thinner from a side of the operation portion 21*a* toward an open end. A flange-like projection 21*e* is provided around an outer circumference in a central part in a longitudinal direction of the brake portion 21*b*.

The open end side of the brake portion 21*b* from the projection 21*e* is divided into four side walls by four slits provided in the longitudinal direction. Each of the four side walls constitutes a swingable portion 21*d* which includes a protrusion 21*f* protruding outwardly from an end of the swingable portion 21*d*. A chamfer 21*g* is formed in an upper corner of the protrusion 21*f*.

When the attachment portion 27 is inserted into the engagement hole 21*c* in the adjuster 21 so as to engage the adjuster engagement portion 27*b* with the engagement hole 21*c*, the adjuster 21 is fixed to the second caster portion 10*b*. Accordingly, when the adjuster 21 is externally rotated, the adjuster 21 and the attachment bolt 27*a* are integrally rotated.

The rear end portion 8*h* of the leg support main body 8 partially includes the protruding portion 8*k* protruding downward. An end surface (hereinafter also referred to as a "caster attachment surface 35") of the protruding portion 8*k* is parallel to the floor surface F. The protruding portion 8*k* of the leg support main body 8 includes a screw hole 41, into which the attachment bolt 27*a* is screwable, formed in a vertical direction from the caster attachment surface 35.

A circular groove 43 is provided around the screw hole 41 in a concentric manner with the screw hole 41. When the attachment bolt 27*a* of the second caster portion 10*b* is screwed into the screw hole 41, the brake portion 21*b* of the adjuster 21 is inserted into the circular groove 43. The circular groove 43 has a stepwise configuration such that a groove width becomes smaller in a central part in a depth direction An inner wall surface 43*a*, which is an inner side surface of the circular groove 43, is slightly outwardly oblique from the caster attachment surface 35 toward a bottom surface 43*b* of the circular groove 43. An outer side surface of the circular groove 43 includes a first outer wall surface 43*c* on a side of the bottom surface 43*b* and a second outer wall surface 43*d* on a side of the caster attachment surface 35. The first outer wall surface 43*c* has a diameter smaller than an outer diameter of the protrusion 21*f* protruding outwardly from the end of the swingable portion 21*d* of the adjuster 21. The second outer wall surface 43*d* has a diameter substantially the same as an outer diameter of the projection 21*e* provided in the longitudinally central part of the brake portion 21*b*.

The caster attachment surface 35 of the leg support main body 8 includes a recess 45 having a configuration and a depth so as to be capable of housing the adjuster lock member 31. The recess 45 extends from a part of the circular groove 43 along an extending direction of the leg support main body 8. A screw hole 47, into which the fixing screw 33 for fixing the adjuster lock member 31 is screwable, is provided from a bottom surface 45*a* of the recess 45 in a vertical direction.

The second caster portion 10*b* is attached to the protruding portion 8*k* of the leg support main body 8 when the attachment bolt 27*a* is screwed into the screw hole 41. As the attachment bolt 27*a* is screwed into the screw hole 41, the brake portion 21*b* in the adjuster 21 fixed to the second caster portion 10*b* becomes inserted into the circular groove 43. As described above, the outer diameter of the protrusion 21*f* protruding outwardly from the end of the swingable portion 21*d*, which is included in the brake portion 21*b*, is larger than the diameter of the first outer wall surface 43*c* of the circular groove 43. Accordingly, when the brake portion 21*b* is inserted into the circular groove 43, the protrusion 21*f* abuts the first outer wall surface 43*c* thereby to cause an inward deformation of the swingable portion 21*d*. Due to the inward deformation, the swingable portion 21*d* outwardly biases the first outer wall surface 43*c*.

The chamfer 21*g* is formed in the upper corner of the protrusion 21*f*, i.e., in the end of the swingable portion 21*d*, such that an outer diameter of the swingable portion 21*d* is smaller than the first outer wall surface 43*c*. Accordingly, when the second caster portion 10*b* is attached to the rear end portion 8*h* of the leg support main body 8, the adjuster 21 can be inserted smoothly into the circular groove 43 with the swingable portion 21*d* abutting an edge 43*f* of the first outer wall surface 43*c* and being inwardly deformed.

As shown in FIG. 10A and FIG. 10B, while the projection 21*e* of the adjuster 21 is housed in the circular groove 43 and is located deeper than the bottom surface 45*a* of the recess 45, the adjuster lock member 31 is fixed to the recess 45 with the fixing screw 33. In this state, an end 31*a* of the adjuster lock member 31 on a side of the circular groove 43 projects into an opening surface of the circular groove 43.

The protruding portion 8*k* of the leg support main body 8 is a circular arc-shaped outer configuration around an axis of the screw hole 41, and the operation portion 21*a* has a same diameter as a diameter of the circular arc-shape of the protruding portion 8*k* of the leg support main body 8. Accordingly, the operation portion 21*a* may be disposed under the leg support main body 8 in good appearance without protruding outwardly from the leg support main body 8.

A description of an operation of the adjuster 21 in use will now be provided. In the height adjusting device, when the operation portion 21*a* of the adjuster 21 located under the rear end portion 8*h* of the leg support main body 8 is rotated in a clockwise direction, the attachment bolt 27*a* is rotated along with the adjuster 21. As a result, a screwed amount between the attachment bolt 27*a* and the screw hole 41 is increased. Accordingly, a distance between the caster attachment surface 35 and the floor surface F is decreased, and the height of the rear end portion 8*h* of the leg support main body 8 from the floor surface F is decreased. As shown in FIG. 10B, when an upper surface 21*j* of the projection 21*e* provided in the adjuster 21 abuts a surface 43*e* in a stepwise portion of the circular groove 43, a further rotation of the adjuster 21 in a clockwise direction is prevented.

When the operation portion 21*a* is rotated in a counterclockwise direction, the attachment bolt 27*a* is rotated along with the adjuster 21, and the screwed amount between the attachment bolt 27*a* and the screw hole 41 is decreased. Accordingly, the distance between the caster attachment surface 35 and the floor surface F is increased, and the height of the rear end portion 8*h* of the leg support main body 8 from the floor surface F is increased. As shown in FIG. 10A, when a lower surface 21*h* of the projection 21*e* provided in the adjuster 21 abuts an upper surface 31*b* of the end 31*a* of the adjuster lock member 31 projecting into the opening surface of the circular groove 43, a further rotation of the adjuster 21 in the counterclockwise direction is prevented.

According to the movable desk 1 of the present embodiment, as described above, when the top panel 2 is rotated to the in-use position, the synchronization rod 76, the stopper rod 82 and the stopper 84 are moved downward through the rotation of the cam 72. When the stopper rod 82 is moved downward, the stopper rod 82 slides through the hollow portion 20*d* of the hollow shaft member 20, and therefore, the stopper 84 is brought into contact with a predetermined position of the floor surface F. That is, the movable desk 1 can be securely fixed to the floor surface F by a simple structure.

When the top panel 2 is rotated, only the synchronization rod 76, the stopper rod 82, and the stopper 84 are upwardly and downwardly moved. Accordingly, a user may easily rotate the top panel 2 upward to the storage position without being required to apply a large force to rotate the top panel 2.

Since the first caster portion 10*a* is separated from the floor surface F when the top panel 2 is in the in-use position, the movable desk 1 can be fixed securely by the stopper 84. Since the leg pole 6 and the first caster portion 10*a* are adapted to be moved upward when the top panel 2 is rotated to the in-use position, i.e., the top panel 2 is pushed downward by the user, the user may efficiently apply a force to the top panel 2. Thus, the top panel 2 may easily be rotated.

The first caster portion 10*a*, including the caster main body 22 and the hollow shaft member 20 projecting above the caster main body 22, is screwed to the caster attachment member 12 by a part of the hollow shaft member 20, and is connected to the lower end of the leg pole 6 by the caster attachment member 12. The stopper rod 82 having a rod-like configuration is slid through the hollow portion 20*d* of the hollow shaft member 20 with a vertical axis, thereby causing the stopper 84 to contact the floor surface F below the first caster portion 10*a*.

According to the movable desk 1 of the present embodiment, a good appearance may be achieved since the stopper rod 82 is not exposed outside. Also, since the first caster portion 10*a* is attached to the leg pole 6, the stopper 84 may be caused to contact the floor surface F below the first caster portion 10*a* without providing a complicated structure.

In the movable desk 1 of the present embodiment, the brake mechanism 70 configured as described above may be housed inside the leg pole 6 and the first caster portion 10*a*. Accordingly, it may be possible to project the stopper 84 from the lower end of the leg pole 6 through the first caster portion 10*a* so as to contact the floor surface F, thereby to securely fix the movable desk 1 to the floor surface F, regardless of the configuration of the leg support 7.

The cam 72 is fixed to the cam shaft 48, which is connected to the stepped rotary shaft 38 as a rotation shaft of the top panel 2 in an integrally rotatable manner. Accordingly, the rotation of the top panel 2 may be directly transmitted to the synchronization rod 76 through the rotation of the cam 72, and thus a more simplified configuration of the movable desk 1 may be achieved.

In the movable desk 1 of the present embodiment, while the leg pole 6 is engaged with the engagement groove 8*a* and the engagement groove 1la, and sandwiched by the leg support main body 8 and the leg support attachment member 11, the attachment bolts 13 are inserted through the insertion holes 11*c* formed on respective sides of the engagement groove 1la. When the attachment bolts 13 are inserted through the insertion holes 11*c* and are screwed into the respective screw holes 8*c* formed in the leg support main body 8, the leg support main body 8 and the leg support attachment member 11 are fastened with each other.

According to the movable desk 1 of the present embodiment, as described above, while the pair of second side walls 6*d* respectively abut the bottom surface 8*f* of the engagement groove 8*a* and the bottom surface 11*f* of the engagement groove 11*a*, the leg pole 6 is pressed by the front end portion 8*e* of the leg support main body 8 and the leg support attachment member 11 by these abutting surfaces. Accordingly, the leg support 7 may be securely connected to the leg pole 6.

Also, the leg support 7 may be easily detached from the leg pole 6 by removing the attachment bolts 13 and thereby releasing a pressed state by the front end portion 8*e* of the leg support main body 8 and the leg support attachment member 11. Since the screw holes 8*c*, into which the attachment bolts 13 are screwed, are formed on both sides of the engagement groove 8*a*, the leg support 7 may be fixed to the leg pole 6 without providing holes in the leg pole 6 for inserting the attachment bolts 13 therethrough.

Since the leg support 7 is constituted by the leg support main body 8 and the leg support attachment member 11, a specified part of the leg pole 6 may be easily sandwiched by the front end portion 8*e* of the leg support main body 8 and the leg support attachment member 11. Accordingly, it may be possible to easily replace the leg support 7 even after assembly of the movable desk 1 is finished.

In the movable desk 1 of the present embodiment, the projections 11*d* to be engaged with the leg pole 6 are formed in the leg support attachment member 11, while the engagement holes 6*b* to be engaged with the projections 11*d* are formed in the leg pole 6. Accordingly, the leg support attachment member 11 may be properly positioned with respect to the leg pole 6 by engaging the projections 11*d* and the engagement holes 6*b*. Thus, it may be possible to connect the leg support 7 to a specified position of the leg pole 6 without using an assembly jig or the like.

The two projections 11*d* and the two engagement holes 6*b* are respectively provided to be spaced each other along a direction perpendicular to the longitudinal direction of the leg pole 6. Accordingly, the leg support attachment member 11 is perpendicularly engaged with the leg pole 6, and thus the leg support 7 may be perpendicularly connected to the leg pole 6.

A connection angle between the leg support 7 and the leg pole 6 is determined by engagement between the engagement holes 6*b* and the projections 11*d* as described above. An accuracy of the connection angle is not high since there actually is a small gap between each of the engagement holes 6*b* and each of the projections 11*d*. The connection angle is also determined to some extent by the engagement between the engagement groove 11*a* and the leg pole 6. However, since the engagement groove 11*a* has a width slightly larger than an exterior width of the leg pole 6, there also is a small gap between the leg pole 6 and the engagement groove 11*a* when engaged with each other. Thus, an accuracy of the connection angle is not high.

In the movable desk 1 of the present embodiment, the pair of parallel side surfaces 8*g* and the bottom surface 8*f* of the engagement groove 8*a* are connected via the surfaces 8*d*, each having an angle of 45 degrees with respect to the bottom surface 8*f* and the adjacent one of the side surfaces 8*g*. As the attachment bolts 13 are screwed, and the leg support main body 8 and the leg support attachment member 11 are gradually fastened, corners 6*f* of the leg pole 6 are pressed against the surfaces 8*d*. As a result, the connection angle is gradually corrected such that the leg pole 6 and the leg support main body 8 become perpendicular to each other. According to the movable desk 1 configured as above, it may be possible to perpendicularly connect the leg support 7 to the leg pole 6 in an accurate manner without using an assembly jig.

In the movable desk 1 of the present embodiment, the leg support attachment member 11 is engaged with the leg pole 6 at the position slightly lower than the central part of the leg pole 6 through the engagement groove 11*a* from the inner side of the leg pole 6. The linear-shaped leg support main body 8 is engaged with the leg pole 6 through the engagement groove 8*a* and is fastened to leg support attachment member 11 from the outer side of the leg pole 6. The engagement groove 8*a* is formed in the central part of the protruding portion 8*j*, which has the substantially elliptical cross section and protrudes toward the inner side of the movable desk 1 in the front end portion 8*e* of the leg support main body 8.

As described above, the leg support main body 8 is located outside of the leg pole 6, i.e., in a position not to overlap the leg pole 6 in the front and rear direction. Accordingly, it may be possible to stack in the front and rear direction a plurality of the movable desks 1, each with the top panel 2 in the substantially vertical storage position, without shifting the movable desks in the right and left direction.

In the movable desk 1 of the present embodiment, the projections 11*d* of the leg support attachment member 11, which are engageable with the engagement holes 6*b* in the leg pole 6, are located to be deviated in an upper and lower direction from a linear line connecting the insertion holes 11*c*, through which the attachment bolts 13 are inserted. In other words, the projections 11*d* are deviated from respective centers of the bottom surfaces 8*f*, 11*f* of the engagement grooves 8*a*, 11*a*. Accordingly, heights of the insertion holes 11*c* may be changed by turning upside down the leg support attachment member 11 and then engaging the projections 11*d* with the engagement holes 6*b* in the leg pole 6. That is, an attachment height of the leg support 7 to the leg pole 6 may be changed by turning upside down the leg support attachment member 11.

By using this feature that the attachment height is changeable, it may be possible to constitute a movable desk 3, including a top panel 5 of a size different from the top panel 2, by replacing only the top panel 2 and the leg support main body 8 of the movable desk 1. A structure of the movable desk 3 will be described below with reference to FIGS. 12A and 12B. Since the movable desk 3 has a same structure as the movable desk 1 except for the top panel 2 and the leg support main body 8, only different points will be described.

The top panel 5, having a rear portion longer than the top panel 2, is made of a rectangular plate material with a width larger than the top panel 2 in a front and rear direction. The top panel 5 is supported by the top panel support portions 30.

A leg support main body 17 includes both ends having same configurations as both ends of the leg support main body 8. The leg support main body 17 is longer than the leg support main body 8 so as to support the top panel 5 in a stabilized manner.

Figure 12A:
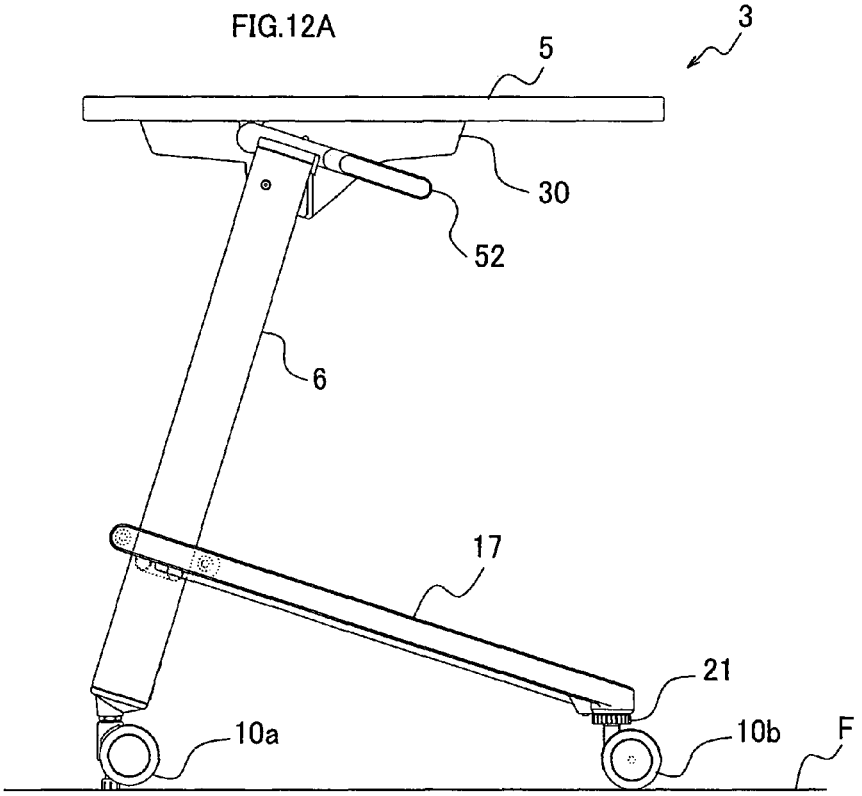
FIG. 12A is a side elevational view showing an appearance of a movable desk with a top panel having a shape different from a shape of the top panel in the present embodiment.
Figure 12B:
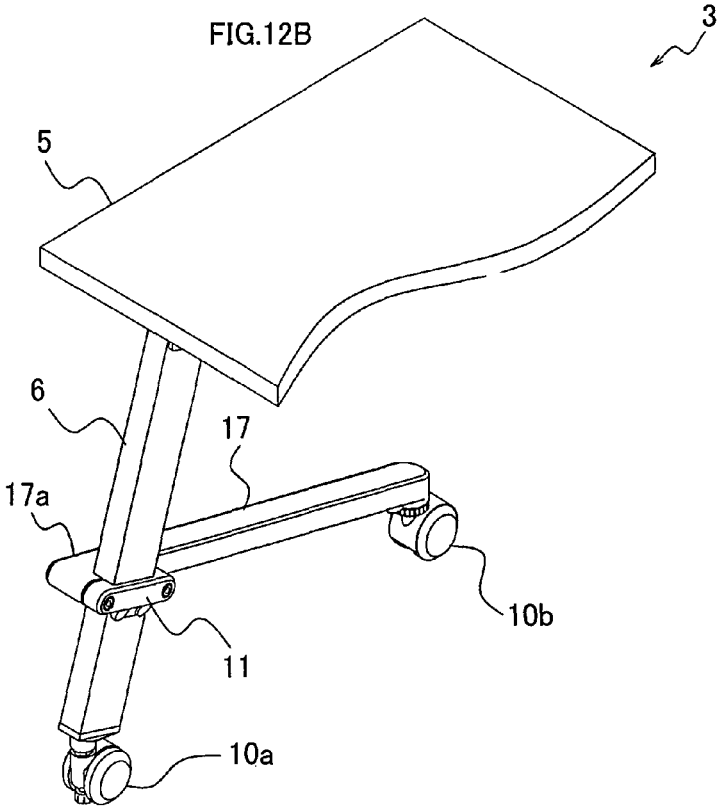
FIG. 12B is a partial perspective view of the movable desk in FIG. 12A.

As shown in FIG. 12A and FIG. 12B, the leg support attachment member 11 with the extending portion 11*g* located downward is engaged with the leg pole 6 through the engagement groove 11*a* from an inner side of the leg pole 6, and the projections 11*d* are engaged with the engagement holes 6*b*. The leg support main body 17 with the second caster portion 10*b* located downward is engaged with the leg pole 6 through an engagement groove (not shown) from an outer side of the leg pole 6. The convex portions 11*b* leg support attachment member 11 are engaged with concave portions (not shown) formed in the leg support main body 17 such that respective end surfaces of the convex portions 11*b* do not reach respective bottom surfaces of the concave portions.

While the leg pole 6 is sandwiched by the leg support main body 17 and the leg support attachment member 11, the attachment bolts 13 are inserted through the insertion holes 11*c* provided on both sides of the engagement groove 11*a* in the leg support attachment member 11, and screwed into respective screw holes formed in the leg support main body 17. Thus, the leg support main body 17 and the leg support attachment member 11 are fastened with each other.

At this time, while the second side walls 6*d* respectively abut the bottom surface of the engagement groove of the leg support main body 17 and the bottom surface 11*f* of the engagement groove 11*a*, the leg pole 6 is pressed by the front end portion 17*a* of the leg support main body 17 and the leg support attachment member 11 by these abutting surfaces. Thus, the leg support main body 17 is perpendicularly connected to the leg pole 6. In this case, the leg support main body 17 has a length such that the second caster portion 10*b* contacts the floor F when the leg support main body 17 is connected to the leg pole 6.

As described above, while the leg support attachment member 11 is engaged with the leg pole 6 such that the extending portion 11*g* is located upward in the movable desk 1, the leg support attachment member 11 is engaged with the leg pole 6 such that the extending portion 11*g* is located downward in the movable desk 3. Accordingly, a connecting position of a leg support to the leg pole 6 in the movable desk 3 is higher than in the movable desk 1. That is, the leg support main body 17 longer than the leg support main body 8 may be connected to the leg pole 6 at a same connection angle as the leg support main body 8 and also at a higher position than the leg support main body 8.

Accordingly, components other than the top panel 2 and the leg support main body 8, such as the leg pole 6 and the leg support attachment member 11 and other components, may be commonly used for both the movable desk 1 and the movable desk 3. This may lead to a reduction of the number of the components, and thus a reduction of manufacturing costs.

In the lock device 51 provided in the movable desk 1 of the present embodiment, the first engaged surface 15*a*, the first engaging surface 55*a*, the second engaged surface 15*b*, and the second engaging surface 55*b* have respective circular arc configurations. Central axes (the B axis or the C axis) of these surfaces are located at positions shifted from a rotation axis (the A axis) of the lock member 54 such that the engaging surfaces are rotated while moving in directions of departing from the respective engaged surfaces, in accordance with the rotation of the operation lever 52.

According to the lock device 51 configured as above, when the operation lever 52 is rotated while the top panel 2 is in the in-use position, the first engaging surface 55*a* is rotated to move in a direction of departing from the first engaged surface 15*a*. When the operation lever 52 is rotated while the top panel 2 is in the storage position, the second engaging surface 55*b* is rotated to move in a direction of departing from the second engaged surface 15*b*. It may, therefore, be possible to avoid inoperable state of the operation lever 52 due to an unreleasable engagement between the engaging portion 55 and the receiving portion 15 caused by friction and undesirable interlock between the engaging surfaces 55*a*, 55*b* and the engaged surfaces 15*a*, 15*b*. And thus, a user can easily operate the operation lever 52 to release a locked state.

Since the lock member 54 is biased by the coil spring 58 in a direction of abutting the receiving portion 15, the engaging surfaces 55*a*, 55*b* approach the engaged surfaces 15*a*, 15*b* along a same moving path as in the case of departing from the engaged surfaces 15*a*, 15*b* when the operation lever 52 is operated. Accordingly, even when the engaged surfaces 15*a*, 15*b* are shifted due to wear of the receiving portion 15, the engaging surfaces 55*a*, 55*b* and the engaged surfaces 15*a*, 15*b* may surely be engaged. It may, therefore, be possible to fix the top panel 2 in the in-use position or the storage position securely without wobbling, regardless of wear of the receiving portion 15.

The first engaged surface 15*a* and the first engaging surface 55*a* have circular arc configurations with the same diameter. The second engaged surface 15*b* and the second engaging surface 55*b* have respective circular arc configurations with the same diameter. Accordingly, the top panel 2 is fixed by surface abutment between the engaging surfaces 55*a*, 55*b* in the engaging portion 55 and the respective engaged surfaces 15*a*, 15 in the receiving portion 15. When an external force is applied to the top panel 2 (for example, when the user attempts to rotate the top panel 2 in a locked state), the engaged surfaces 15*a*, 15*b* are brought into pressing surface contact with the respective engaging surfaces 55*a*, 55*b*. It may, therefore, be possible to distribute the force over the engaging surfaces 55*a*, 55*b* and the engaged surfaces 15*a*, 15*b* through engagement therebetween, and thereby to reduce wear of the surfaces.

According to the lock device 51 in the present embodiment, when an operation of the operation lever 52 is cancelled (when a hand is removed from the operation lever 52) while the top panel 2 is rotated, the end surface 55*c* of the engaging portion 55 of the lock member 54, which is biased by the coil spring 58 toward the upper end surface 15*c*, is slid on the upper end surface 15*c* of the receiving portion 15. Accordingly, a friction resistance is caused between the engaging portion 55 and the upper end surface 15*c*. The friction resistance may serve to suppress rapid rotation of the top panel 2 by a self-weight of the top panel 2 when the top panel 2 is rotated to the in-use position or to the storage position.

In the lock device 51 of the present embodiment, the operation lever 52 and the lock member 54 are provided on the outer side of the top panel receiving fitting 34. An engagement region of the receiving portion 15 and the engaging portion 55, i.e., the thin plate-like lock member 54 and the first plate portion 16*a*, are sandwiched between the leg pole 6 and the top panel receiving fitting 34. In other words, the second side wall 6*d* on the inner side of the leg pole 6 is used as part of the lock device 51 (as a component for covering the engagement region). It may, therefore, be possible to constitute the lock device 51 with a reduced number of components.

In addition, the rotation axis (the A axis) of the lock member 54 is located in an upper vicinity of the rotation axis (i.e., the shaft portion 39), so that the first plate portion 16*a* may be commonly used as a member for supporting the top panel receiving fitting 34 and as an engagement member with the lock member 54. It may, therefore, be possible to achieve substantial downsizing of the lock device 51.

The cover 36 covering the top panel receiving fitting 34 includes the wall portion 36*a* protruding outward from the cover 36. When the top panel 2 is in the in-use position, the engagement region of the receiving portion 15 and the engaging portion 55 is hidden by the wall portion 36*a* located rearward of the first plate portion 16*a*. When the top panel 2 is rotated to the storage position, the wall portion 36*a* is moved to above the receiving portion 15 in accordance with the rotation of the top panel 2. Then, the engagement region of the receiving portion 15 and the engaging portion 55 is hidden by the wall portion 36*a*. Accordingly, it may be possible to avoid the engagement region of the receiving portion 15 and the engaging portion 55 from being externally exposed by a simple constitution without covering the whole lock device 51 with a cover.

In the in-use position or the storage position, the part of the engaging surfaces 55*a*, 55*b* and the part of the respective engaged surfaces 15*a*, 15*b* are engaged with each other, while there is a gap between the end surface 55*c* of the engaging portion 55 and the receiving portion 15. As described above, the engaging surfaces 55*a*, 55*b* approach the engaged surfaces 15*a*, 15*b* along the same moving path as in the case of departing from the engaged surfaces 15*a*, 15*b* when the operation lever 52 is operated.

If a positional relationship between the engaging portion 55 and the receiving portion 15 at the time of assembly is slightly deviated from a designed value, abutment regions between the engaging surfaces 55*a*, 55*b* and the respective engaged surfaces 15*a*, 15*b* may be deviated from designed regions. In this case, however, as the engaging surfaces 55*a*, 55*b* approach along the moving path, the engaging surfaces 55*a*, 55*b* and the respective engaged surfaces 15*a*, 15*b* abut each other in other regions different from the designed regions, and thereby the engaging portion 55 and the receiving portion 15 are securely engaged with each other. According to the lock device 51 in the present embodiment, therefore, it may be possible to allow manufacturing errors in processing and assembly of components of the lock device 51, and relaxation of manufacturing accuracy.

The lock device 51 is provided under each of right and left end portions of the top panel 2. The pair of lock devices 51 are configured such that the lock members 54 on both right and left sides interlockingly operate through the interlock pipe 60. Accordingly, engagement between the engaging portion 55 and the receiving portion 15 in both lock devices 51 may be released at the same time by operating the operation lever 52 on only one side.

In the height adjusting device provided in the movable desk 1 of the present embodiment, the adjuster 21 is fixed to the attachment portion 27 for attaching the second caster portion 10*b* to the leg support main body 8. In the adjuster 21, the brake portion 21*b* upwardly projects from the operation portion 21*a*. When inserted into the circular groove 43, the brake portion 21*b* biases the first outer wall surface 43*c*, thereby to suppress rotation of the adjuster 21.

According to the height adjusting device configured as above, a user may adjust the height of the rear end portion 8*h* of the leg main body 8 from the floor surface simply by rotating the operation portion 21*a*. When the protrusions 21*f* provided in the swingable portion 21*d* abut the first outer wall surface 43*c* and cause a deformation of the swingable portion 21*d*, the swingable portions 21*d* outwardly bias the first outer wall surface 43*c*. Then, a friction resistance caused between the protrusions 21*f* and the first outer wall surface 43*c* may serve to suppress the adjuster 21 from being loosened.

In other words, a substantially simple structure, in which the screw hole 41 and the circular groove 43 are provided in the lower surface of the leg support main body 8, while the adjuster 21 is provided around the attachment bolt 27*a* in the second caster portion 10*b*, may achieve a height adjusting device that allows easy adjustment and secure maintenance of an adjusted state.

Since the brake portion 21*b* has a substantially cylindrical configuration, and the protrusions 21*f* are provided in the swingable portions 21*d* on a side of the first outer wall surface 43*c*, the protrusions 21*f* abut the first outer wall surface 43*c* over substantially the whole circumference of the circular groove 43. Accordingly, abutment of the protrusions 21*f* against the first outer wall surface 43*c* causes a sufficient deformation of the swingable portions 21*d*, so that the swingable portions 21*d* securely bias the first outer wall surface 43*c*. Then, a friction resistance caused between the protrusions 21*f* and the first outer wall surface 43*c* may serve to more securely suppress the adjuster 21 from being loosened.

Since the projection 21*e* provided in the central part of the brake portion 21*b* may be engaged with the upper surface 31*b* of the adjuster lock member 31 projecting into the circular groove 43, it may be possible to avoid the brake portion 21*b* from being detached from the circular groove 43. For example, it may be possible to avoid the second caster portion 10*b* from being detached from the leg support main body 8 even if a user excessively loosens the adjuster 21 when rotating the operation portion 21*a* to adjust the height of the rear end portion 8*h* of the leg support main body 8 from the floor surface F. A movable range of the adjuster 21, that is, an adjustable range of the height of a rear end portion 8*h* of the leg support main body 8 is determined by a position of the projection 21*e*.

Since the projection 21*e* has substantially the same outer diameter as the second outer wall surface 43*d*an end surface 21*k* of the projection 21*e* is abutted by the second outer wall surface 43*d* of the circular groove 43. Accordingly, a friction resistance caused between the projection 21*e* and the second outer wall surface 43*d*in addition to the friction resistance caused between the protrusion 21*f* and the first outer wall surface 43*c*, may serve to more securely suppress the adjuster 21 from being loosened.

In the movable desk 1 of the present embodiment, a front portion of the movable desk 1 is adjustable by changing the screwing amount of the stopper 84 into the stopper rod 82, while a rear portion of the movable desk 1 is adjustable by rotating the adjuster 21 in the second caster portion 10*b*. In other words, respective heights of four floor contact portions of the movable desk 1 may be individually adjusted. It may, therefore, be possible to place the movable desk 1 in a stabilized manner even when the floor surface F is uneven. It may also be possible to adjust the height of the movable desk 1 to a height of another movable desk 1 and the like.

Although one embodiment of the present invention has been described as above, it is to be understood that the present invention may be embodied in various forms without departing from the spirit and scope of the present invention.

Figure 13A:
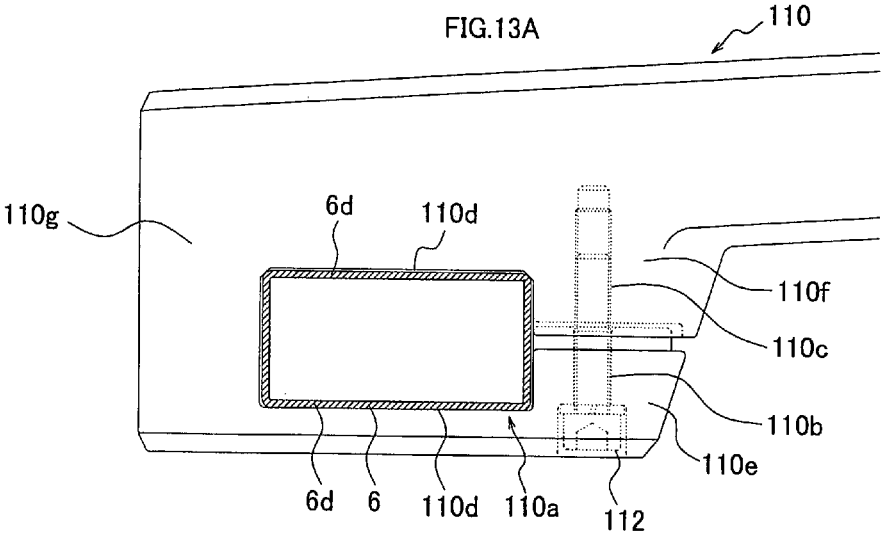
FIGS. 13A through 13C are cross sectional views showing attachment structures between a leg pole and a leg support different from the attachment structure in FIG. 3B.

For example, the leg support 7 in the movable desk 1 of the above embodiment is constituted by the leg support main body 8, the leg support attachment member 11, and two attachment bolts 13. However, as shown in FIG. 13A, the leg support main body 8 and the leg support attachment member 11 may be replaced with an integrally formed component.

Specifically, a leg support 110 is constituted by integrating the leg support main body 8 and the leg support attachment member 11 into a hook-like configuration. A hook portion 10*g* having a hook-like shape defines an engagement hole 110*a* to be engaged with the leg pole 6. The leg pole 6 is inserted through the engagement hole 110*a* from an upper direction or a lower direction, and the second side walls 6*d* of the leg pole 6 are abutted by a pair of opposing surfaces 110*d* of the engagement hole 110*a*.

When a distal end 110*e* of the hook portion 10*g* having an insertion hole 110*b* and a proximal end 110*f* of the hook portion 10*g* having a screw hole 110*c* are fastened with an attachment bolt 112, the leg pole 6 is pressed by the hook portion 10*g* of the leg support 110 through abutment surfaces 110*d*. Thus, the leg support 110 is connected to the leg pole 6.

In the above described embodiment, the end portion (the front end portion 8*e*) of the leg support main body 8 includes a protruding portion 8*j* protruding inward of the movable desk 1, so that the leg support main body 8 is located outside of the leg pole 6. This allows a plurality of the movable desks 1 to be stacked in the front and rear direction without shifting the movable desks in the right and left direction. However, it may be possible to employ a simpler configuration as, for example, a leg support 115 shown in FIG. 13B when it is unnecessary to stack the movable desks 1 in the front and rear direction.

Figure 13B:
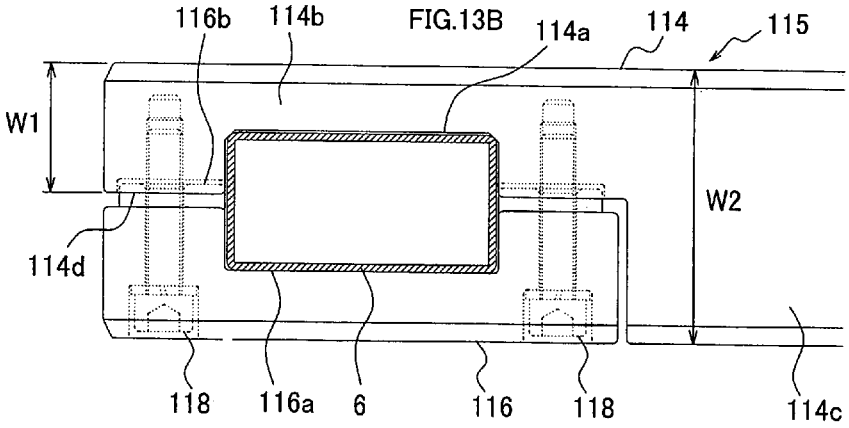

As shown in FIG. 13B, the leg support 115 includes a leg support main body 114, a leg support attachment member 116, and attachment bolts 118. The leg support main body 114 includes a cutout leaving an end portion 114*b* to be connected to the leg pole 6 and a main body 114*c*. A width W1 of the end portion 114*b* in the right and left direction is substantially half of a width W2 of the main body 114*c*. The leg support main body 114 includes a surface 114*d* to be located on the inner side of the movable desk 1 and an engagement groove 114*a* formed in the surface 114*d* so as to be engageable with the leg pole 6.

The leg support attachment member 116 has a rectangular block-like configuration so as to fill the cutout leaving the end portion 114*b* of the leg support main body 114. The leg support attachment member 116 includes a surface 116*b* facing the leg support main body 114 and an engagement groove 116*a* formed in the surface 116*b* so as to be engageable with the leg pole 6. The leg support main body 114 and the leg support attachment member 116 are fastened with each other with attachment bolts 118 in a same manner as in the above described embodiment.

According to the leg support 115 configured as above, when the leg support main body 114 and the leg support attachment member 116 are fastened with each other, the leg pole 6 is sandwichingly held in a central position of the leg support 115 in the right and left direction. In this case, the leg support main body 114 extends rearward in a position overlapping the leg pole 6 in the front and rear direction. Accordingly, a simpler appearance of the movable desk 1 may be achieved.

In the movable desk 1 of the above described embodiment, the bottom surface 8*f* of the engagement groove 8*a* in the leg support main body 8 and the bottom surface 11*f* of the engagement groove 11*a* in the leg support attachment member 11 abut the second side walls 6*d* of the leg pole 6. In other words, the leg pole 6 is adapted to be pinched from the right and left directions. However, as shown in FIG. 13C, the leg pole 6 may be adapted to be pinched from the front and rear directions.

Figure 13C:
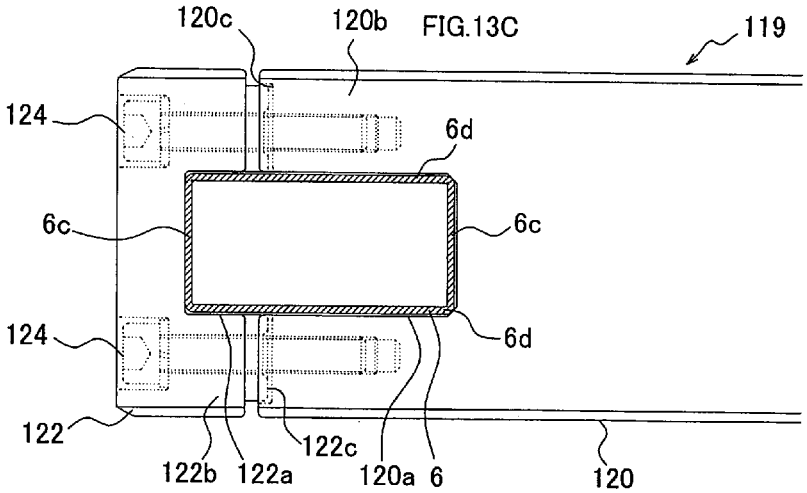

As shown in FIG. 13C, a leg support 119 includes a leg support main body 120 to be located rearward of the leg pole 6, a leg support attachment member 122 to be located forward of the leg pole 6, and attachment bolts 124. The leg support main body 120 includes a linear rod-like member having a rectangular cross section. The leg support main body 120 includes a front end portion 120*b* with an end surface 120*c*. The end surface 120*c* includes an engagement groove 120*a* having a width slightly larger than the width of the first side wall 6*c* of the leg pole 6 and a depth of approximately two-thirds of the width of the second side wall 6*d*.

The leg support attachment member 122 is a block-like member having a same cross section as the leg support main body 120. The leg support attachment member 122 includes a rear end portion 122*b* with an end surface 122*c*. The end surface 122*c* includes an engagement groove 122*a* having a same width as the engagement groove 120*a*. A depth of the engagement groove 122*a* is such that the end surface 122*c* does not abut the end surface 120*c* of the leg support main body 120 when the leg support main body 120, which is engaged with the leg pole 6 from the rear direction, is engaged with the leg pole 6.

While the leg support attachment member 122 is engaged with the leg pole 6 from the front direction, the leg support main body 120 is engaged with the leg pole 6 from the rear direction. Then, the leg support main body 120 and the leg support attachment member 122 are fastened with each other with the attachment bolts 124 on both right and left sides of the leg pole 6. Thus, the leg support main body 120 is connected to the leg pole 6.

In the above described connection method between the leg pole 6 and the leg support 7, the attachment bolts 13 are arranged so as not to penetrate the leg pole 6. However, attachment bolts may be arranged so as to penetrate the leg pole 6. In this case, it may be necessary to previously form insertion holes for insertion of the attachment bolts therethrough in a pair of parallel side walls (e.g., the second side walls 6*d*) to be abutted by engagement grooves of respective members, such as a leg support main body and a leg support attachment member.

In the movable desk 1 of the above described embodiment, the leg pole 6 is arranged in the upper and lower direction with the upper end of the leg pole 6 slightly slanting rearward, and the leg support 7 is perpendicularly connected to the leg pole 6. However, arrangement angles should not be limited to these angles.

For example, a leg pole vertically arranged with respect to the floor F, or a leg support horizontally arranged may be employed. In a case of arranging the leg support and leg pole perpendicular to each other, it is possible to fasten the leg support and the leg support attachment member with an attachment bolt in a vicinity of the leg pole, thereby to securely connect the leg support to the leg pole. The leg support and the leg pole need not be arranged perpendicular to each other as long as a predetermined connection strength may be secured.

In the present embodiment, the projections 11*d* are provided in the leg support attachment member 11 as engagement portions to determine a position of connecting the leg support main body 8 to the leg pole 6. however, the engagement portions may be provided in the leg support main body 8.

The leg support 7 may have one of a variety of configurations. For example, when there are a plurality of contact portions between the leg pole 6 and the leg support 7, it may be possible to fasten the leg pole 6 by pinching from both sides at each of the contact portions. It may also be possible to fasten the leg pole 6 by pinching from both sides at only one of the contact portions and forming engagement portions for positioning at the remaining contact portions.

The connection method between the leg pole 6 and the leg support 7 in the movable desk 1 of the present embodiment may be applied to a fixed desk without the caster portions 10.

The leg support 7 of the movable desk 1 of the present embodiment includes the height adjusting device for adjusting the height of the rear end portion 8*h* of the leg support main body 8 from the floor surface F. The height adjusting device may have a configuration other than the configuration in the present embodiment.

Figures 14A, 14B, 14C:
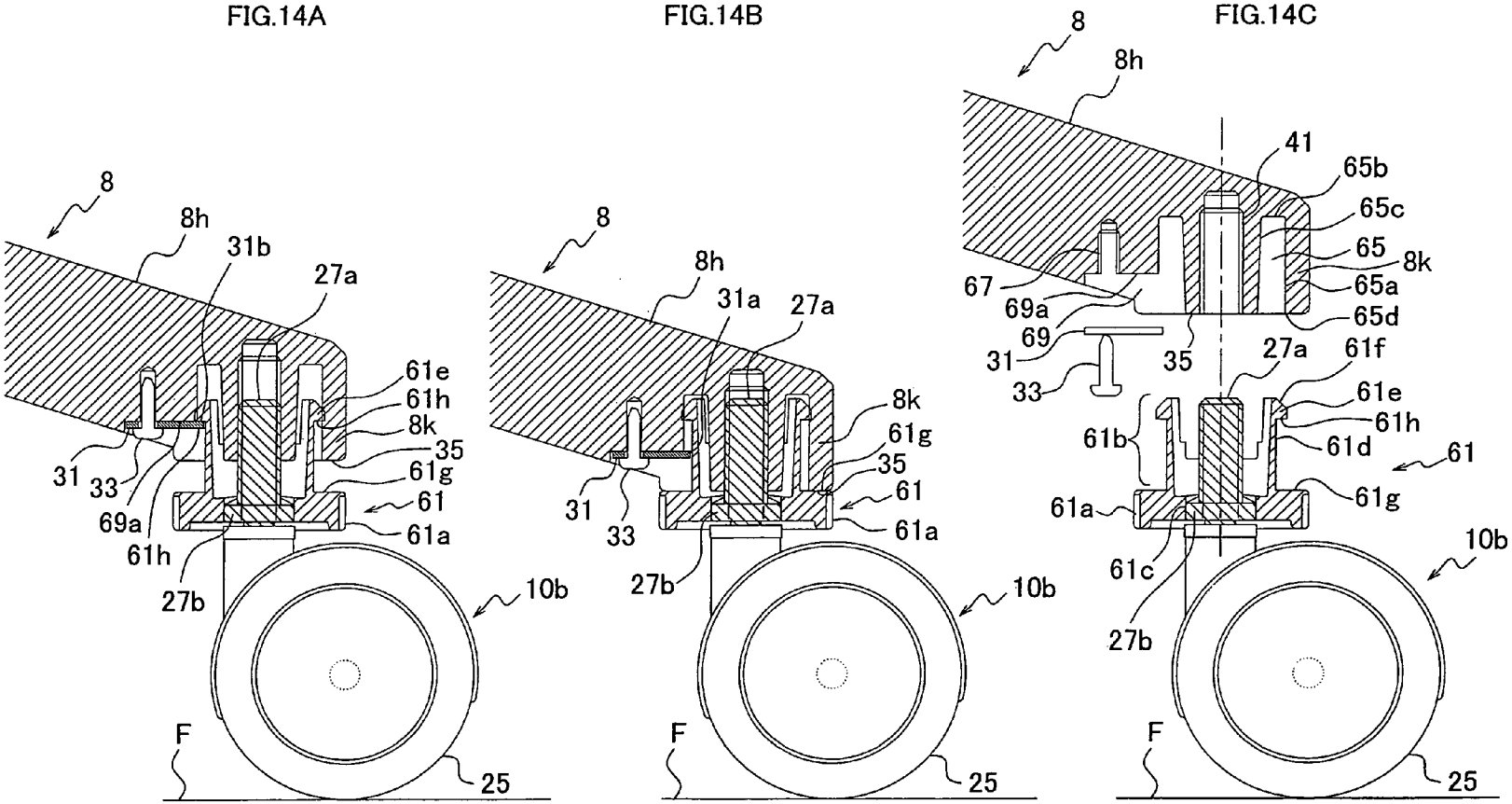
FIGS. 14A through 14C are cross sectional views showing a height adjusting device different from the height adjusting device in FIGS. 10A through 10C.

For example, it may be possible to employ an adjuster 61 as shown in FIG. 14A to FIG. 14C and provide a circular groove 65 corresponding to the adjuster 61 in the rear end portion 8*h* of the leg support main body 8. FIG. 14A to FIG. 14C are cross sectional views of the rear end portion 8*h* of the leg support main body 8 taken along a plane, which passes through a center of the adjuster 61 and is parallel to the longitudinal direction of the leg support main body 8.

The adjuster 61, formed of synthetic resin as the adjuster 21, includes a flange-like operation portion 61*a* and a brake portion 61*b*. The operation portion 61*a* is externally operable. The brake portion 61*b* upwardly projects from the operation portion 61*a* in a cylindrical configuration and is inserted into the leg support main body 8.

The operation portion 61*a* has a disk-like configuration having a diameter larger than a diameter of the brake portion 61*b*. The operation portion 61*a* includes an engagement hole 61*c* in a central part thereof. The engagement hole 61*c* is insertable around the attachment bolt 27*a* and also engageable with the hexagonal adjuster engagement portion 27*b*.

The brake portion 61*b* has a substantially cylindrical configuration such that a side wall gradually becomes thinner from a side of the operation portion 61*a* toward an open end. An open end side from a central part in a longitudinal direction of the brake portion 61*b* is divided into four side walls by four slits provided in the longitudinal direction.

Each of the four side walls constitutes a swingable portion 61*d* which includes a protrusion 61*e* protruding outwardly from an end portion of the swingable portion 61*d*. A chamfer 61*f* is formed in an upper corner of the protrusion 61*e*.

When the attachment portion 27 is inserted into the engagement hole 61*c* in the adjuster 61 so as to engage the adjuster engagement portion 27*b* with the engagement hole 61*c*, the adjuster 61 is fixed to the second caster portion 10*b*. Accordingly, when the adjuster 61 is externally rotated, the adjuster 61 and the attachment bolt 27*a* are integrally rotated.

In the leg support main body 8, a circular groove 65 is provided around the screw hole 41, into which the attachment bolt 27*a* is screwable, in a concentric manner with the screw hole 41. When the attachment bolt 27*a* of the second caster portion 10*b* is screwed into the screw hole 41, the brake portion 61*b* of the adjuster 61 is inserted into the circular groove 65.

The circular groove 65 has a width gradually narrowing toward a bottom surface 65*b* of the circular groove 65. An inner wall surface 65*c*, which is an inner side surface of the circular groove 65, is slightly outwardly oblique toward the bottom surface 65*b*. An outer side surface 65*a* of the circular groove 65 has a constant diameter smaller than an outer diameter of the protrusion 61*e* protruding outwardly from the end portion of the swingable portion 61*d* of the adjuster 61.

The caster attachment surface 35 of the leg support main body 8 includes a recess 69 having a configuration so as to be capable of housing the adjuster lock member 31. The recess 69 extends from a part of the circular groove 65 along an extending direction of the leg support main body 8. The recess 69 is provided at approximately half the depth of the circular groove 65, so that when the adjuster lock member 31 is fixed to a bottom surface 69*a* of the recess 69, a part of the adjuster lock member 31 projects into the circular groove 65 in a longitudinal central part of the circular groove 65. A screw hole 67, into which the fixing screw 33 for fixing the adjuster lock member 31 is screwable, is provided from a bottom surface 69*a* of the recess 69 in a vertical direction.

The second caster portion 10*b* is attached to the rear end portion 8*h* of the leg support main body 8 when the attachment bolt 27*a* is screwed into the screw hole 41. As the attachment bolt 27*a* is screwed, the brake portion 61*b* becomes inserted into the circular groove 65. As described above, the outer diameter of the protrusion 61*e* protruding outwardly from the end portion of the swingable portion 61*d*, which is included in the brake portion 61*b*, is larger than the diameter of the outer wall surface 65*a* of the circular groove 65. Accordingly, when the brake portion 61*b* is inserted into the circular groove 65, the protrusion 61*e* abuts the outer wall surface 65*a* thereby to cause an inward deformation of the swingable portion 61*d*. Due to the inward deformation, the swingable portion 61*d* outwardly biases the outer wall surface 65*a*.

The chamfer 61*f* is formed in the upper corner of the protrusion 61*e* such that an outer diameter in the upper end portion of the swingable portion 61*d* is smaller than the outer wall surface 65*a* of the circular groove 65. Accordingly, when the second caster portion 10*b* is attached, the adjuster 61 can be inserted smoothly into the circular groove 65 with the swingable portion 61*d* abutting an edge 65*d* of the outer wall surface 65*a* and being inwardly deformed.

As shown in FIG. 14A, while the protrusion 61*e* of the adjuster 61 is located deeper than the bottom surface 69*a* of the recess 69, the adjuster lock member 31 is fixed to the recess 69 with the fixing screw 33. In this state, an end 31*a* of the adjuster lock member 31 projects toward the longitudinal central part of the circular groove 65.

A description of an operation of the adjuster 61 in use will now be provided. When the operation portion 61*a* of the adjuster 61 is rotated in a clockwise direction, the attachment bolt 27*a* is rotated along with the adjuster 61. As a result, a screwed amount between the attachment bolt 27*a* and the screw hole 41 is increased. Accordingly, a distance between the caster attachment surface 35 and the floor surface F is decreased, and the height of the rear end portion 8*h* of the leg support main body 8 from the floor surface F is decreased. As shown in FIG. 14B, the operation portion 61*a* can be rotated in the clockwise direction until an upper surface 61*g* of the operation portion 61*a* of the adjuster 61 abuts the caster attachment surface 35.

When the operation portion 61*a* is rotated in a counterclockwise direction, the attachment bolt 27*a* is rotated along with the adjuster 61, and the screwed amount between the attachment bolt 27*a* and the screw hole 41 is decreased. Accordingly, the distance between the caster attachment surface 35 and the floor surface F is increased, and the height of the rear end portion 8*h* of the leg support main body 8 from the floor surface F is increased. As shown in FIG. 14A, when a lower surface 61*h* of the protrusion 61*e* provided at an upper end of the brake portion 61*b* of the adjuster 61 abuts an upper surface 31*b* of the end 31*a* of the adjuster lock member 31 projecting into the circular groove 65, a further rotation of the adjuster 61 in the counterclockwise direction is prevented.

According to the height adjusting device configured as above, a user may adjust the height of the leg support 7 from the floor surface simply by rotating the operation portion 61*a* of the adjuster 61. When the protrusion 61*e* provided in the swingable portion 61*d* abuts the outer wall surface 65*a* and causes a deformation of the swingable portion 61*d*, the swingable portion 61*d* outwardly biases the outer wall surface 65*a*. Then, a friction resistance caused between the protrusion 61*e* and the outer wall surface 65*a* may serve to suppress the adjuster 61 from being rotated, and thus being loosened.

Since the brake portion 61*b* has a substantially cylindrical configuration, and the protrusions 61*e* are provided in the swingable portions 61*d* on a side of the outer wall surface 65*a*, the protrusions 61*e* abut the outer wall surface 65*a* over substantially the whole circumference of the circular groove 65. Accordingly, abutment of the protrusions 61*e* against the outer wall surface 65*a* causes a sufficient deformation of the swingable portions 61*d*, so that the swingable portions 61*d* securely bias the outer wall surface 65*a*. Then, a friction resistance caused between the protrusions 61*e* and the outer wall surface 65*a* may serve to more securely suppress the adjuster 61 from being loosened.

Since the protrusion 61*e* may be engaged with the adjuster lock member 31 projecting into the circular groove 65, it may be possible to avoid the brake portion 61*b* from being detached from the circular groove 65. For example, it may be possible to avoid the second caster portion 10*b* from being detached from the leg support main body 8 even if a user excessively loosens the adjuster 61 when rotating the operation portion 61*a* to adjust the height of the rear end portion 8*h* of the leg support main body 8 from the floor surface F. A movable range of the adjuster 61, that is, an adjustable range of the height of a rear end portion 8*h* of the leg support main body 8 is determined by the depth of the recess 69.

Figure 15:
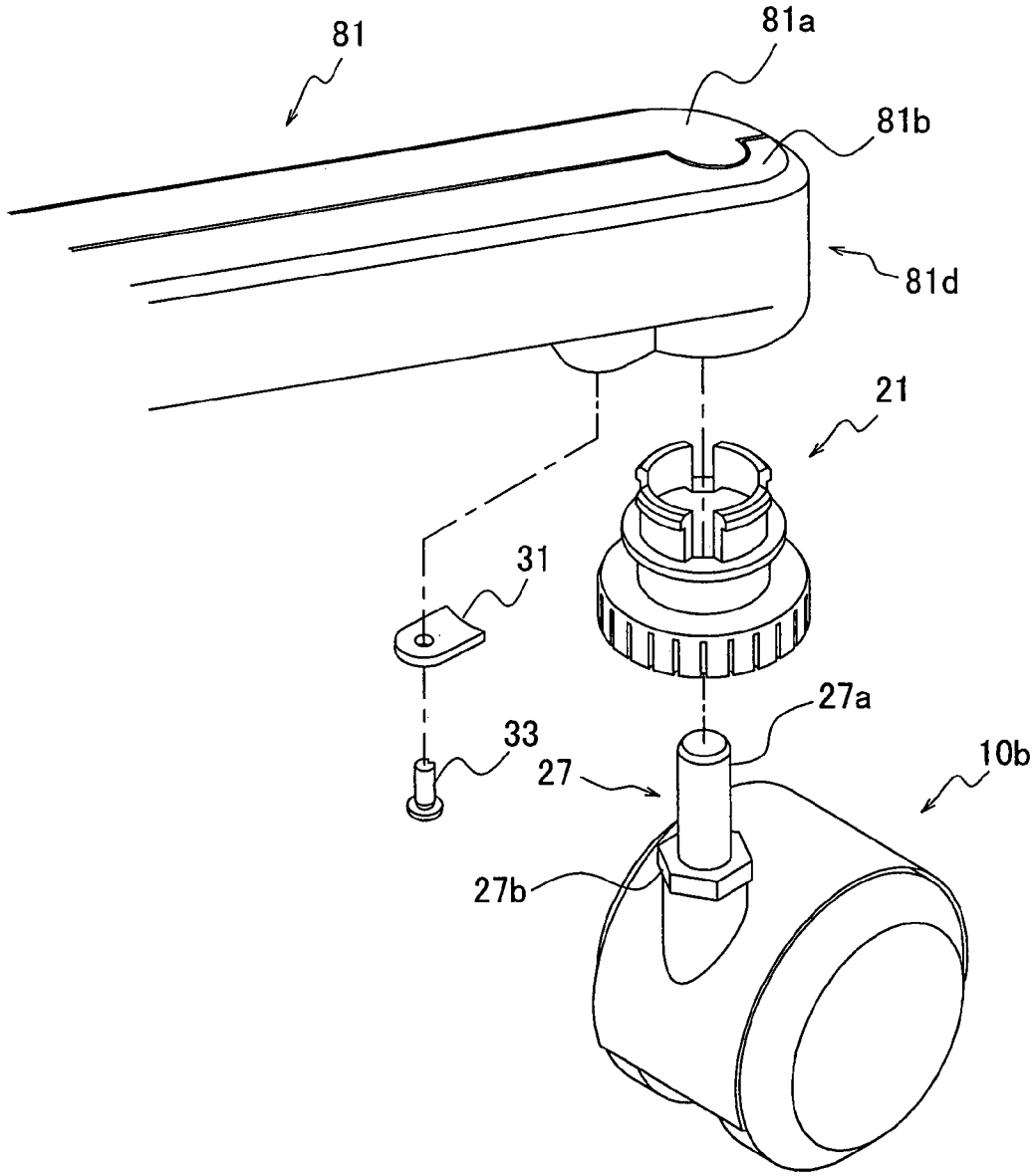
FIG. 15 is an exploded perspective view of a height adjusting device different from the height adjusting device in FIG. 9.
Figure 16C:
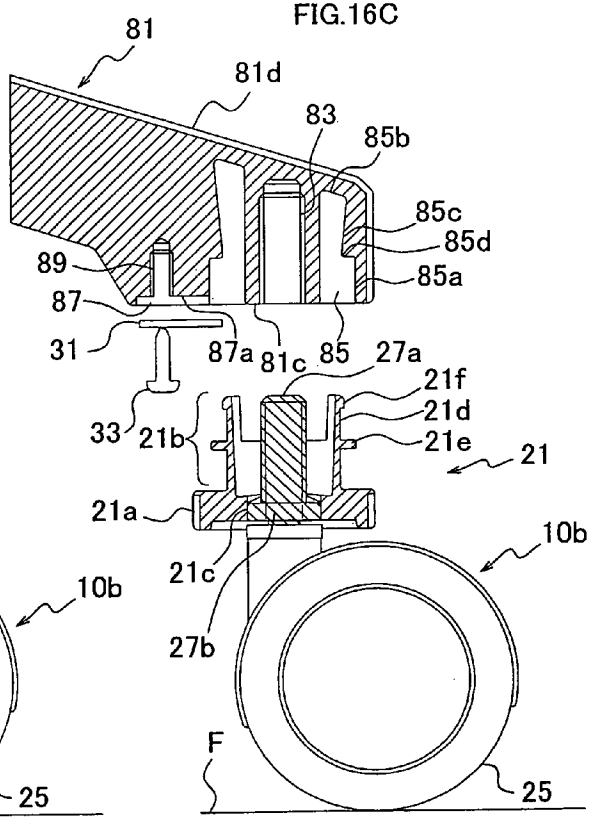
FIG. 16C is an exploded cross sectional view showing the structure of the height adjusting device in FIG. 15.
Figure 16B:
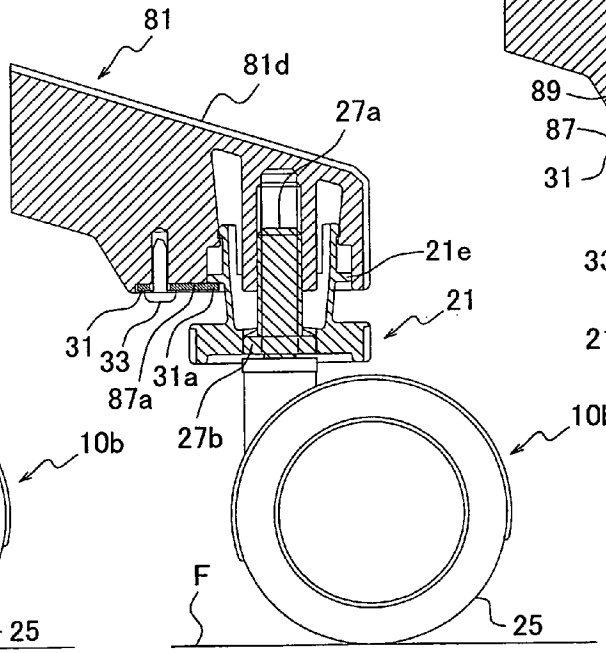
FIG. 16B is a cross sectional view showing the structure of the height adjusting device in FIG. 15 when the lower end of the leg support main body is located at a lowest position.
Figure 16A:
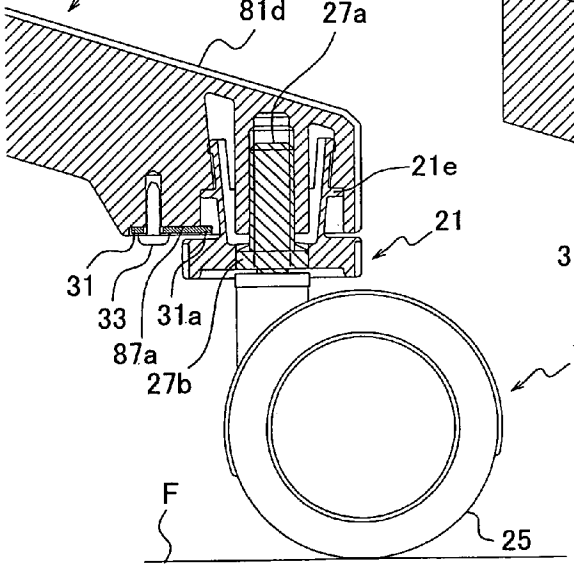
FIG. 16A is a cross sectional view showing the structure of the height adjusting device in FIG. 15 when a lower end of a leg support main body is located at a highest position.

Alternatively, a height adjusting device may be achieved by using a leg support main body 81 different from the leg support main body 8 in the above described embodiment and the adjuster 21 used in the above described embodiment, as shown in FIG. 15 and FIG. 16A-FIG.16C. FIG. 16A to FIG. 16C are cross sectional views of a rear end portion 81*d* of the leg support main body 81 taken along a plane, which passes through the center of the adjuster 21 and is parallel to the longitudinal direction of the leg support main body 81.

The leg support main body 81, having a rod-like configuration as the leg support main body 8, includes one end which is connected to the leg pole 6. As shown in FIG. 15, the leg support main body 81 is divided into two members, i.e., a first member 81*a* and a second member 81*b*, along a longitudinal direction of the leg support main body 81. The first member 81*a* includes a screw portion for attachment of the second caster portion 10*b*, while the second member 81*b* constitutes the remaining portion of the leg support main body 81.

The rear end portion 81*d* of the leg support main body 81 protrudes downward, and includes a lower end surface (hereinafter also referred to as a "caster attachment surface 81*c*") parallel to the floor surface F. The rear end portion 81*d* of the leg support main body 81, specifically a rear end portion of the first member 81*a*, includes a screw hole 83, into which the attachment bolt 27*a* is screwable, formed in a vertical direction from the caster attachment surface 81*c*. A circular groove 85 is provided around the screw hole 83 in a concentric manner with the screw hole 83. When the attachment bolt 27*a* of the second caster portion 10*b* is screwed into the screw hole 83, the brake portion 21*b* of the adjuster 21 is inserted into the circular groove 85.

As shown in FIG. 16C, the circular groove 85 has a width which remains constant from an open end to a longitudinal central part of the circular groove 85 and narrows in a stepwise manner in the longitudinal central part. The circular groove 85 includes a tapered configuration from the longitudinal central part to a bottom surface 85*b* of the circular groove 85, having a width gradually widened toward the bottom surface 85*b*.

The circular groove 85 has an outer side wall, including a first outer wall surface 85*a* located on a side of the open end and a second outer wall surface 85*c* located on a side of the bottom surface 85*b*. In the second outer wall surface 85*c*, a portion into which the brake portion 21*b* of the adjuster 21 is inserted has a diameter smaller than an outer diameter of the protrusion 21*f* protruding outwardly from the end portion of the swingable portion 21*d*. The first outer wall surface 85*a* has a diameter substantially the same as an outer diameter of the projection 21*e* provided in the longitudinal central part of the brake portion 21*b* of the adjuster 21.

The caster attachment surface 81*c* of the leg support main body 81 includes a recess 87 having a configuration and a depth so as to be capable of housing the adjuster lock member 31. The recess 87 extends from a part of the circular groove 85 along an extending direction of the leg support main body 81. A screw hole 89, into which the fixing screw 33 for fixing the adjuster lock member 31 is screwable, is provided from a bottom surface 87*a* of the recess 87 in a vertical direction.

The second caster portion 10*b* is attached to the rear end portion 81*d* of the leg support main body 81 when the attachment bolt 27*a* is screwed into the screw hole 83. As the attachment bolt 27*a* is screwed into the screw hole 83, the brake portion 21*b* in the adjuster 21 fixed to the second caster portion 10*b* becomes inserted into the circular groove 85. As described above, the diameter of the second outer wall surface 85*c* of the circular groove 85 in a region into which the brake portion 21*b* is inserted is smaller than the outer diameter of the protrusion 21*f* protruding outwardly from the end portion of the swingable portion 21*d*. Accordingly, when the brake portion 21*b* is inserted into the circular groove 85, the protrusion 21*f* abuts the second outer wall surface 85*c* thereby to cause an inward deformation of the swingable portion 21*d*. Due to the inward deformation, the swingable portion 21*d* outwardly biases the second outer wall surface 85*c*.

The outer diameter of the second outer wall surface 85*c* where a groove width is narrowed is larger than the diameter of the upper end of the swingable portion 21*d*. Accordingly, when the second caster portion 10*b* is attached, the adjuster 21 can be inserted smoothly into the circular groove 85 with the swingable portion 21*d* abutting an edge 85*d* of the second outer wall surface 85*c* and being inwardly deformed.

As shown in FIG. 16A and FIG. 16B, while the projection 21*e* of the adjuster 21 is housed in the circular groove 85 and is located deeper than the bottom surface 87*a* of the recess 87, the adjuster lock member 31 is fixed to the recess 87 with the fixing screw 33. In this state, the end 31*a* of the adjuster lock member 31 projects into an opening surface of the circular groove 85.

The adjuster 21 functions by an operation of a user in a same manner as the adjuster 21 in the above described embodiment, and results in same effects as the height adjusting device in the above described embodiment.

Especially in the present height adjusting device, the circular groove 85 has a tapered configuration from the longitudinal central part to the bottom surface 85*b* of the circular groove 85, having a width gradually widened toward the bottom surface 85*b*.

Then, a friction resistance, caused between the protrusions 21*f* and the second outer wall surface 85*c* when the adjuster 21 is moved downward, may be larger than in the case of the constant diameter of the outer wall surfaces. This serves to more securely suppress the adjuster 21 from being loosened.

Figures 17A, 17B, 17C:
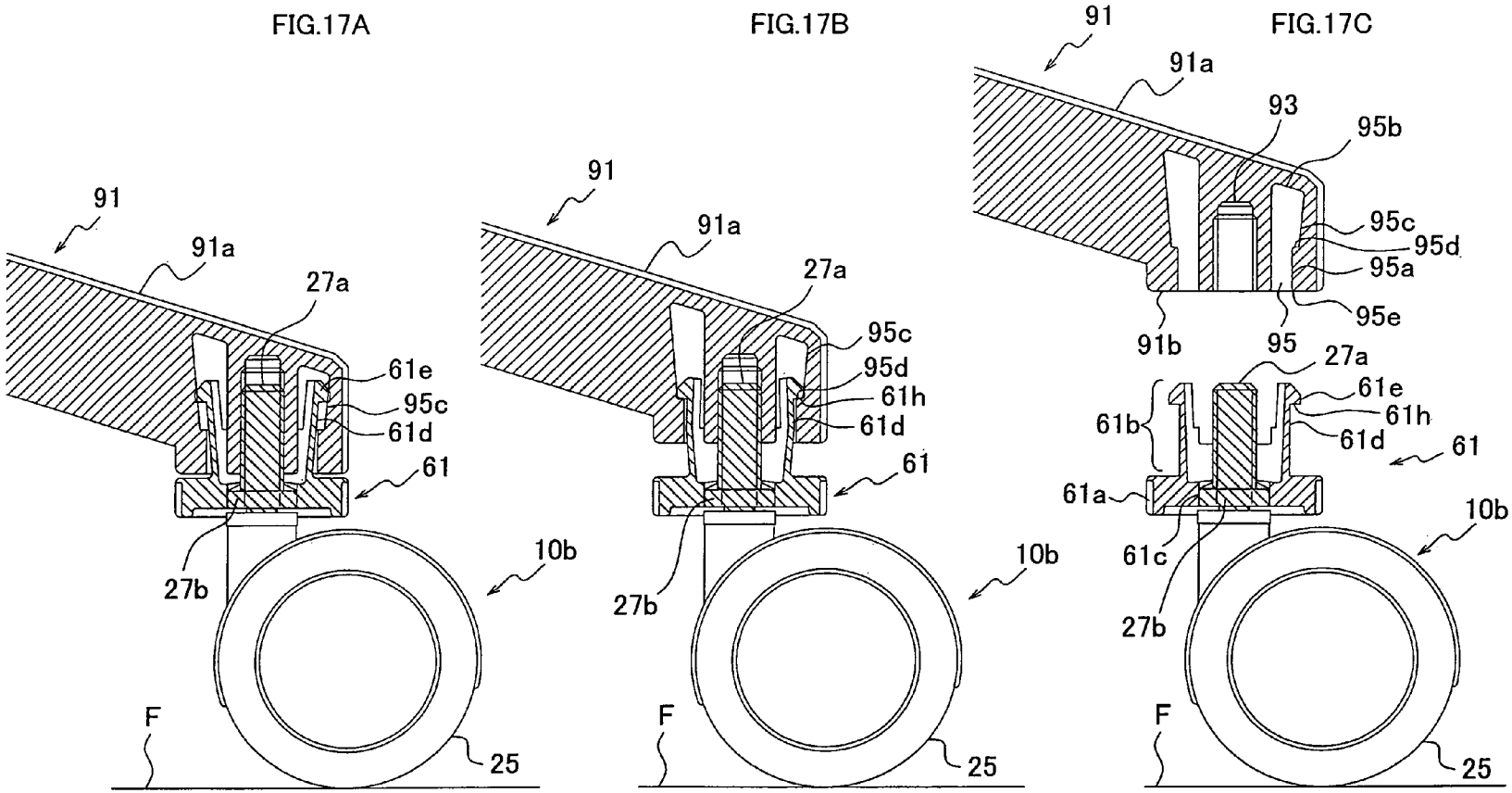
FIGS. 17A through 17C are cross sectional views showing a height adjusting device different from the height adjusting device in FIGS. 16A through 16C.

Alternatively, as shown in FIG. 17A to FIG. 17C, a height adjusting device may be constituted by a leg support main body 91 and the above described adjuster 61.

FIG. 17A to FIG. 17C are cross sectional views of a rear end portion of the leg support main body 91 taken along a plane, which passes through a center of the adjuster 61 and is parallel to the longitudinal direction of the leg support main body 91. An appearance of the leg support main body 91 is a same as the appearance of the leg support main body 81 shown in FIG. 15.

The leg support main body 91, having a rod-like configuration as the leg support main body 81, includes one end which is connected to the leg pole 6. The leg support main body 91 is divided into two members, i.e., a first member 91*a* and a second member 91*b*, along a longitudinal direction of the leg support main body 91. The first member 91*a* includes a screw portion for attachment of the second caster portion 10*b*, while the second member (not shown) constitutes the remaining portion of the leg support main body 91.

The rear end portion of the leg support main body 91 protrudes downward, and includes a lower end surface (hereinafter also referred to as a "caster attachment surface 91*b*") parallel to the floor surface F. The rear end portion of the leg support main body 91 includes a screw hole 93, into which the attachment bolt 27*a* is screwable, formed in a vertical direction from the caster attachment surface 91*b*. A circular groove 95 is provided around the screw hole 93 in a concentric manner with the screw hole 93. When the attachment bolt 27*a* of the second caster portion 10*b* is screwed into the screw hole 93, the brake portion 61*b* of the adjuster 61 is inserted into the circular groove 95.

As shown in FIG. 17C, the circular groove 95 has a width which remains constant from an open end to a longitudinal central part of the circular groove 95 and narrows in a stepwise manner in the longitudinal central part. The circular groove 95 includes a tapered configuration from the longitudinal central part to a bottom surface 95*b* of the circular groove 95, having a width gradually widened toward the bottom surface 95*b*.

The circular groove 95 has an outer side wall, including a first outer wall surface 95*a* located on a side of the open end and a second outer wall surface 95*c* located on a side of the bottom surface 95*b*. In the second outer wall surface 95*c*, a portion into which the brake portion 61*b* of the adjuster 61 is inserted has a diameter smaller than the outer diameter of the protrusion 61*e* protruding outwardly from the end portion of the swingable portion 61*d*. The first outer wall surface 95*a* has a diameter allowing insertion of the swingable portion 61*d* of the adjuster 61 therethrough in an inwardly deformed state.

The second caster portion 10*b* is attached to the rear end portion of the leg support main body 91 when the attachment bolt 27*a* is screwed into the screw hole 93. As the attachment bolt 27*a* is screwed into the screw hole 93, the swingable portion 61*d* of the brake portion 61*b* in the adjuster 61 fixed to the second caster portion 10*b* is inwardly deformed and becomes inserted into the circular groove 95. When the swingable portion 61*d* is inserted to a stepwise portion 95*d* having a widened width, the protrusion 61*e* protruding outwardly from the end portion of the swingable portion 61*d* is brought into engagement with the stepwise portion 95*d*, as shown in FIG. 17B.

As described above, the outer diameter of the protrusion 61*e* is larger than the diameter of the second outer wall surface 95*c* of the circular groove 95. Accordingly, when the attachment bolt 27*a* is screwed further and the swingable portion 61*d* is inserted deeper than the stepwise portion 95*d* of the circular groove 95, as shown in FIG. 17A, the protrusion 61*e* abuts the second outer wall surface 95*c* thereby to cause an inward deformation of the swingable portion 61*d*. Due to the inward deformation, the swingable portion 61*d* outwardly biases the second outer wall surface 95*c*.

The first outer wall surface 95*a* of the circular groove 95 is larger than the outer diameter of the upper end of the swingable portion 61*d*. Accordingly, when the second caster portion 10*b* is attached, the adjuster 61 can be inserted smoothly into the circular groove 95 with the swingable portion 61*d* abutting an edge 95*e* of the first outer wall surface 95*a* and being inwardly deformed.

The adjuster 61 in the present height adjusting device functions by an operation of a user in a same manner as the above described adjuster 61. According to the present height adjusting device, same effects as in the above described height adjusting devices may be achieved.

It is to be noted, however, that in the present height adjusting device, when the lower surface 61*h* of the protrusion 61*e* provided to the adjuster 61 is engaged by the stepwise portion 95*d* of the circular groove 95, as shown in FIG. 17B, a rotation of the adjuster 61 in the counterclockwise direction is prevented. Accordingly, it may be possible to avoid the second caster portion 10*b* from being detached from the leg support main body 91 without providing a member for preventing detachment of the second caster portion 10*b*.

As described above, the circular groove 95 includes a tapered configuration from the longitudinal central part to the bottom surface 95*b* of the circular groove 95, having the width gradually widened toward the bottom surface 95*b*. Accordingly, a friction resistance caused between the protrusion 61*e* and the second outer wall surface 95*c* when the adjuster 61 is moved downward is larger than in the case where a substantially vertical outer wall surface is provided, serving to more securely suppress the adjuster 61 from being loosened.

In each of the above described height adjusting devices, the protrusion is provided so as to protrude outwardly from the end portion of the brake portion of the adjuster. However, an additional protrusion protruding inwardly may be provided. Alternatively, only a protrusion protruding inwardly may be provided. As long as a sufficient friction resistance to suppress rotation of the adjuster is caused between the brake portion and the side wall of the circular groove, it is not always necessary to provide any protrusion.

While the brake portion of the adjuster has a cylindrical configuration in the present embodiment, the brake portion may simply be constituted by a plurality of plate portions projecting upward from the operation portion and capable of causing a friction resistance with the side wall of the circular groove when inserted into the circular groove.

Each of the above described height adjusting devices may be applied to any kind of furniture, such as a table, a chair, and the like, other than to the movable desk 1 of the present embodiment.

In the lock device 51 in the movable desk 1 of the present embodiment, the rotation axis of the lock member 54 (i.e., the A axis) when the top panel 2 is in the in-use position is arranged forward of the rotation axis of the top panel 2 (i.e., the shaft portion 39). However, a rotation axis of a lock member when the top panel 2 is in the in-use position may be arranged rearward of the rotation axis of the top panel 2. A description will now be provided on the lock device 63 including such an arrangement of the rotation axis of the lock member with reference to FIG. 18A-FIG. 18C. The lock device 63 is different from the lock device 51 only in a configuration of a bearing portion and a configuration and position of a lock member. Therefore, description of the same components as those of the lock device 51 will be omitted, and only different components will be described below.

Figure 18A:
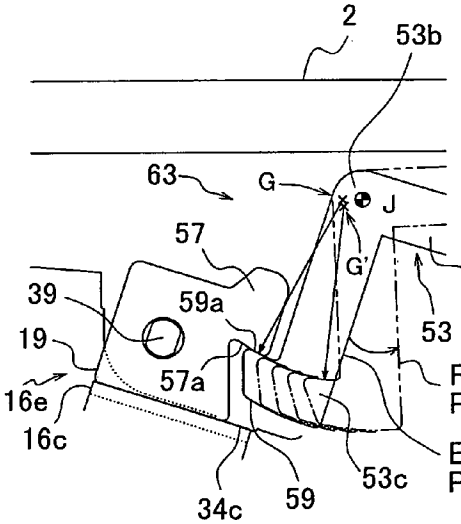
FIGS. 18A through 18C are side elevational views showing a positional relationship between the receiving portion and the engaging portion of a lock device different from the lock device in FIG. 8A through FIG. 8C.

As shown in FIG. 18A-FIG. 18, the lock device 63 including an operation lever (not shown), a lock member 53, and a coil spring (not shown) is provided under the top panel 2. The bearing portion 16*e* includes a third plate portion 19 instead of the above-described first plate portion 16*a*. A receiving portion 57 is provided in an upper end of the third plate portion 19 so as to protrude rearward. Once the lock member 53 is engaged with the receiving portion 57, the top panel 2 is secured in each of the in-use position and the storage position so as not to be rotated by an external force.

The lock member 53 includes a plate-like lock main body 53*a* having an L-shaped configuration, an L-shaped corner portion 53*b*, and a rod-like connecting portion (not shown) provided perpendicularly from the L-shaped corner portion 53*b* in the lock main body 53*a*. The connecting portion is inserted through an insertion hole (not shown) formed in the top panel receiving fitting 34, and thereby the lock member 53 is rotatably supported by the top panel receiving fitting 34 around the connecting portion. Hereinafter, a rotation axis of the lock member 53 is referred to as a "J axis". The insertion hole formed in the top panel receiving fitting 34 is located more rearward than the above described insertion hole 34*b*.

The lock main body 53*a* includes one end (not shown) to be located on the rear end side of the top panel 2. The operation lever is fixed to the one end. The lock main body 53*a* includes the other end 53*c* provided with an engaging portion 59, which protrudes opposite to an extending direction of the one end and is engageable with the receiving portion 57.

The third plate portion 19 of the bearing portion 16*e* and the lock member 53 (and thus the receiving portion 57 and the engagement portion 59) are arranged in an identical plane perpendicular to the top panel 2. Accordingly, when the operation lever is not operated, the engaging portion 59 is constantly abutted by the receiving portion 57.

Figure 18B:
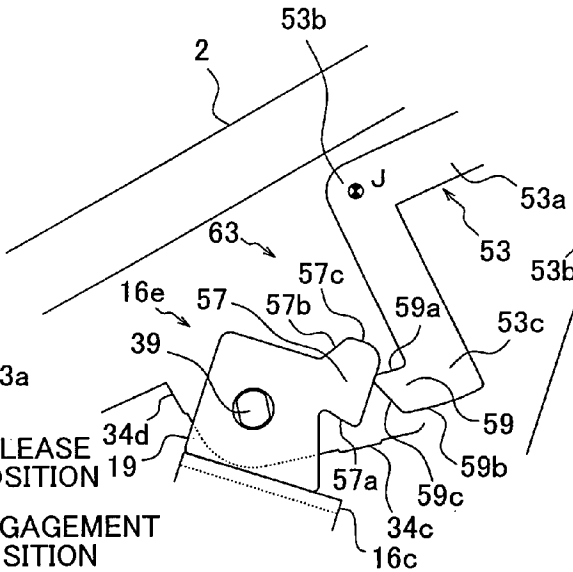
Figure 18C:
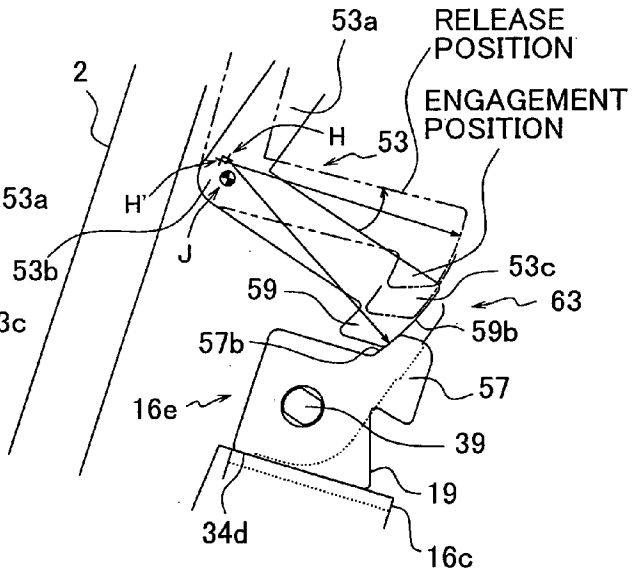

When the top panel 2 is in the in-use position, as shown in FIG. 18A, a part of a first engaged surface 57*a* defining a lower surface of the receiving portion 57 and a part of a first engaging surface 59*a* defining a surface of the engaging portion 59 on the J axis side engage with each other, thereby preventing rotation of the top panel 2. When the top panel 2 is in the storage position, as shown in FIG. 18C, a part of a second engaged surface 57*b* defining a front surface of the receiving portion 57 and a part of a second engaging surface 59*b* defining a surface of the engaging portion 59 on a side facing opposite to the J axis engage with each other, thereby preventing rotation of the top panel 2.

The first engaged surface 57*a* and the first engaging surface 59*a* have respective circular arc configurations with a same diameter around a G axis which is parallel to the J axis and is located slightly forward of the J axis. Accordingly, as shown in FIG. 18A, when the top panel 2 is positioned in the in-use position, and thus the lock member 53 is in an engagement position where the receiving portion 57 and the engaging portion 59 are engaged with each other, the first engaged surface 57*a* and the first engaging surface 59*a* mate with each other.

The second engaged surface 57*b* and the second engaging surface 59*b* have respective circular arc configurations with a same diameter around an H axis, which is parallel to the J axis and is located forward of and obliquely above the J axis. Accordingly, as shown in FIG. 18C, when the top panel 2 is positioned in the storage position, and thus the lock member 53 is in an engagement position where the receiving portion 57 and the engaging portion 59 are engaged with each other, the second engaged surface 57*b* and the second engaging surface 59*b* mate with each other.

To rotate the top panel 2 from the storage position to the in-use position, the operation lever is first rotated toward the top panel 2. Then, the lock member 53 is rotated from the engagement position toward a release position, and the first engaging surface 59*a* is rotated to move in a direction of departing from the first engaged surface 57*a*. Specifically, since the G axis is forward of the J axis, a central axis of the first engaging surface 59*a* is shifted downward from the G axis, in accordance with a rotation of the lock member 53 in a counterclockwise direction around the J axis. That is, the central axis of the first engaging surface 59*a* is shifted to a G' axis closer to the first engaged surface 57*a* than the G axis.

Accordingly, while the central axis of the first engaged surface 57*a* remains the G axis, the central axis of the first engaging surface 59*a* is shifted from the G axis to the G' axis in accordance with the rotation of the lock member 53. As a result, the first engaging surface 59*a* is rotated to move in a direction of departing from the first engaged surface 57*a*. Thus, an engagement between the first engaged surface 57*a* and the first engaging surface 59*a* is released.

When the top panel 2 is pushed upward while the engagement between the first engaged surface 57*a* and the first engaging surface 59*a* is released as described above, the top panel 2 is rotated upward. When a hand is removed from the operation lever while the top panel 2 is rotated, the lock member 53 is biased by the coil spring in a direction of abutting the receiving portion 57. A part of an end surface 59*c* of the engaging portion 59 abuts an upper end surface 57*c* of the receiving portion 57, as shown in FIG. 18B. The part of the end surface 59*c* is slid on the upper end surface 57*c* in accordance with the rotation of the top panel 2.

When the top panel 2 is further rotated, the front end surface 34*d* of the top panel receiving fitting 34 abuts the bottom plate portion 16*c* of the bearing portion 16*e*. Then, the top panel 2 is positioned in the storage position, and the engaging portion 59 is moved to a forward of the receiving portion 57 so that the part of the second engaged surface 57*b* and the part of the second engaging surface 59*b* engage with each other, as shown in FIG. 18C.

To rotate the top panel 2 from the storage position to the in-use position, the operation lever is-first rotated toward the top panel 2. Then, the lock member 53 is rotated from the engagement position to the release position, and thereby the second engaging surface 59*b* is rotated to move in a direction of departing from the second engaged surface 57*b*. Specifically, since the H axis is above the J axis, a central axis of the second engaging surface 59*b* is shifted forward from the H axis, in accordance with a rotation of the lock member 53 in a counterclockwise direction around the J axis. That is, the central axis of the second engaging surface 59*b* is shifted to an H' axis more distant from the second engaged surface 57*b* than the H axis.

Accordingly, while the central axis of the second engaged surface 57*b* remains the H axis, the central axis of the second engaging surface 59*b* is shifted from the H axis to the H' axis in accordance with the rotation of the lock member 53. As a result, the second engaging surface 59*b* is rotated to move in a direction of departing from the second engaged surface 57*b*. Thus an engagement between the second engaged surface 57*b* and the second engaging surface 59*b* is released.

When the top panel 2 is pushed downward while the engagement between the second engaged surface 57*b* and the second engaging surface 59*b* is released as described above, the top panel 2 is rotated downward. When a hand is removed from the operation lever while the top panel 2 is rotated, the part of the end surface 59*c* is slid on the upper end surface 57*c* in accordance with the rotation of the top panel 2 in a same manner as in the case where the top panel 2 is rotated from the in-use position to the storage position.

When the top panel 2 is further rotated, the lower end surface 34*c* of the top panel receiving fitting 34 abuts the bottom plate portion 16*c* of the bearing portion 16*e*. Then, the top panel 2 is positioned in the in-use position, and the engaging portion 59 is moved downward of the receiving portion 57 so that the part of the first engaged surface 57*a* and the part of the first engaging surface 59*a* engage with each other, as shown in FIG. 18A.

In the above-described case where the rotation axis of the lock member is arranged rearward of the rotation axis of the top panel 2, same effects as in the lock member in the present embodiment may be achieved. In this case, however, an engagement region of the receiving portion 57 and the engaging portion 59 is externally exposed when the top panel 2 is in the storage position. Accordingly, the engagement region may be covered with a covering or the like.

In the lock device 51 in the movable desk 1 of the present embodiment, the engaging surface and the engaged surface have respective circular arc configurations with the same diameter. However, the diameter of the engaged surface may be smaller than the diameter of the engaging surface. For example, the first engaged surface 15*a* may have a circular arc configuration around a central axis which passes through a line (e.g., the arrow K in FIG. 7A) connecting the B axis and an abutting point between the first engaging surface 55*a* and the engaged surface 15*a*, so as to be engageable with the first engaging surface 55*a*.

Although the lock device 51 is used to-fix the top panel 2 in the present embodiment, the lock device 51 may also be used in a piece of furniture having a rotating portion to fix the rotating portion at a predetermined position.

Figure 19B:
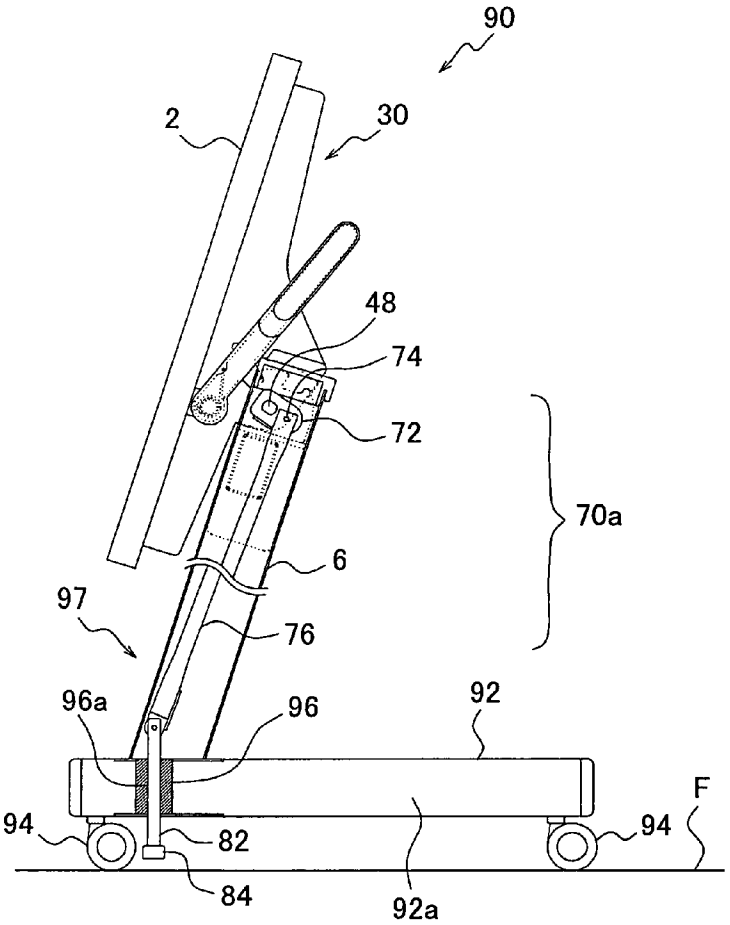
FIG. 19B is a side elevational view showing an appearance of the movable desk of modified example 1 when the top panel is in a storage position.
Figure 19A:
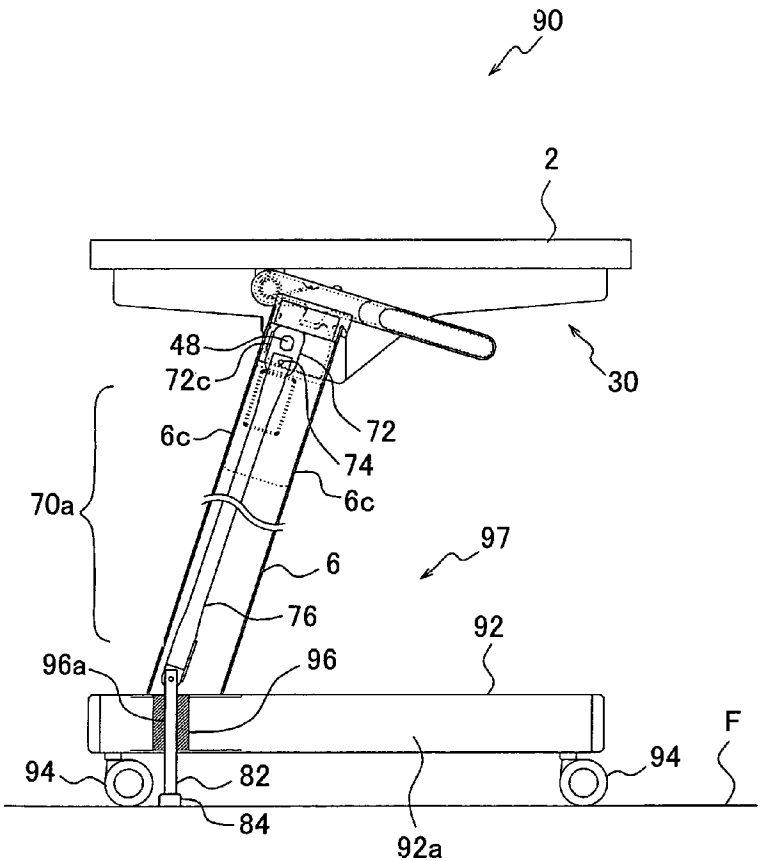
FIG. 19A is a side elevational view showing an appearance of a movable desk of modified example 1 when a top panel is in an in-use position.

When partially modified, the brake mechanism 70 in the movable desk 1 of the present embodiment may be applied to a movable desk 90 including a leg support 92 which is different from the leg support 7 in the movable desk 1. A description of the movable desk 90 in Modification 1, to which the brake mechanism 70*a* which is partially modified is applied, will be provided below with reference to FIG. 19A and FIG. 19B. In FIG. 19A and FIG. 19B, the leg pole 6 and the leg support 92 are shown as partial cross-sectional views taken along a vertical plane and as partial transparent views, in order to show the structure of a brake mechanism 70*a*.

The movable desk 90 is configured to be immovable relative to a floor surface F when a top panel 2 is in a substantially horizontal in-use position and movable relative to the floor surface F when the top panel 2 is in a substantially vertical storage position.

As shown in FIG. 19A and FIG. 19B, the movable desk 90 includes the top panel 2, the pair of top panel support portions 30, a pair of legs 97 and the pair of brake mechanisms 70*a*.

The top panel 2 is made of a rectangular plate material. The pair of top panel support portions 30 are secured to an under surface of the top panel 2 at respective longitudinal end portions of the top panel 2. The legs 97 rotatably support the top panel 2 and the top panel support portion 30 between the in-use position and the storage position. The pair of brake mechanisms 70*a* are provided inside the pair of legs 97, respectively, in order to prevent movement of the movable desk 90 when the top panel 2 is in the in-use position.

The pair of legs 97 include the leg poles 6 and a pair of leg support 92, respectively. Each of the leg poles 6 is disposed in an upper and lower direction with an upper end of the leg pole 6 slightly slanting rearward.

Each of the pair of leg supports 92 is provided at a lower end of each of the leg poles 6 so as to horizontally extend in the front and rear direction. Casters 94 are provided under respective front and rear ends of the leg support 92. The leg support 92, including a hollow portion 92*a* extending in the front and rear direction, is connected to the leg pole 6 at a connecting portion slightly rearward of the front end of the leg support 92. An undersurface of the leg support 92 is a free surface except in regions in which the casters 94 are provided. The hollow portion 92*a* in the leg support 92 is connected to a hollow portion of an inside of the leg pole 6 in the connecting portion with the leg pole 6.

Each of the brake mechanisms 70*a* is provided inside the leg pole 6 and the leg support 92 in order to prevent movement of the movable desk 90 when the top panel 2 is in the in-use position. The brake mechanism 70*a* includes the cam 72, the synchronization rod 76, the stopper rod 82, the stopper 84, and a guide member 96.

The cam 72 is connected to a cam shaft 48. The synchronization rod 76 includes one end swingably connected to the cam 72. The stopper rod 82 includes one end swingably connected to a swingable end of the synchronization rod 76 through a connection fitting 78. The stopper 84 is connected to the stopper rod 82 at the other end opposite to the one end connected to the synchronization rod 76. The guide member 96 is provided in the hollow portion 92*a* of the leg support 92.

The guide member 96 has a block-like configuration including a hollow portion 96*a*, through which the stopper rod 82 is insertable. The guide member 96 is fixed to the leg support 92 under the connecting portion with the leg pole 6.

The stopper rod 82 swingably connected to the synchronization rod 76 is inserted through the hollow portion 96*a* of the guide member 96, and projects from a lower end of the leg support 92. The stopper 84 is screwed to the lower end of the stopper rod 82.

In the movable desk 90 configured as above, when the top panel 2 is in the substantially horizontal in-use position, as shown in FIG. 19A, the cam 72 is located such that the base portion 72*c* is parallel to a first side wall 6*c* of the leg pole 6. The pin 74 serving as a connecting point with the synchronization rod 76 is located below the rotation center of the cam 72, i.e., the cam shaft 48. In this case, the synchronization rod 76 is located at the lowest position inside the leg pole 6, and the stopper 84 contacts the floor surface F. Accordingly, the movable desk 90 is secured so as not to move when the top panel 2 is in the in-use position due to a friction between the stopper 84 and the floor surface F.

When the top panel 2 is rotated upward to the substantially vertical storage position (a position forming an angle of approximately 80 degrees between the top panel 2 and the floor surface F in Modification 1) as shown in FIG. 19B, the cam 72 is rotated with the top panel 2 in a counterclockwise direction. At the same time, the position of the pin 74 as the connecting point with the synchronization rod 76 is also rotated to be located obliquely right below the rotation center of the cam 72.

At this time, the synchronization rod 76 is moved from the lowest position to a highest position inside the leg pole 6, and the stopper rod 82 inserted through the hollow portion 96*a* of the guide member 96 is moved vertically upward in a sliding manner inside the hollow portion 96*a*.

Accordingly, the stopper 84 provided at a lower end of the stopper rod 82 is also moved vertically upward to be separated from the floor surface F. Thus, the movable desk 90 is movable with the casters 94 which constantly contacts the floor surface F.

When the top panel 2 is pushed downward to be rotated back to the in-use position, the cam 72 is rotated with the top panel 2 in a clockwise direction, and the pin 74 is moved to be located again below the rotation center of the cam 72.

At this time, the synchronization rod 76 is moved downward, and the stopper rod 82 inserted through the hollow portion 96*a* of the guide member 96 is moved vertically downward in a sliding manner inside the guide member 96. Then, the stopper 84 is brought into contact with the floor surface F.

According to the movable desk 90 as described above, when the top panel 2 is rotated to the in-use position, the synchronization rod 76, the stopper rod 82, and the stopper 84 are moved downward through the rotation of the cam 72. When the stopper rod 82 is slid downward inside the hollow portion 96*a* of the guide member 96, and the stopper 84 is brought into contact with a predetermined position of the floor surface F. That is, the movable desk 90 can be securely fixed to the floor surface F by a simple structure.

When the top panel 2 is rotated, only the synchronization rod 76, the stopper rod 82, and the stopper 84 are upwardly and downwardly moved. Accordingly, a user may easily rotate the top panel 2 even upward to the storage position without being required to apply a large force to rotate the top panel 2.

Figure 20B:
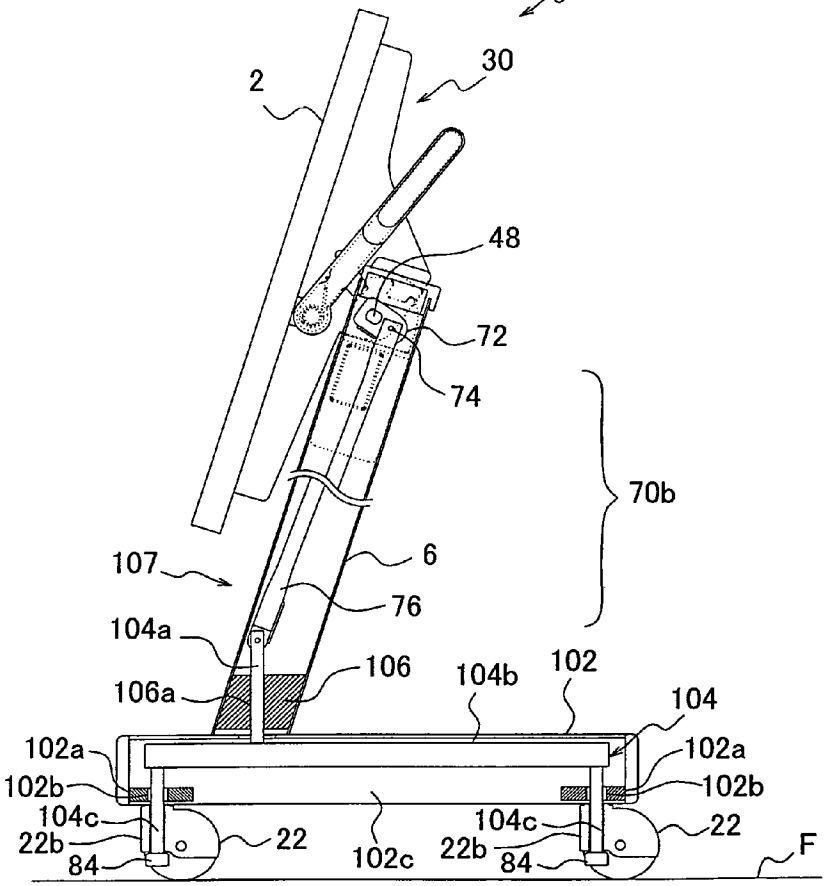
FIG. 20B is a side elevational view showing an appearance of the movable desk of modified example 2 when the top panel is in a storage position.
Figure 20A:
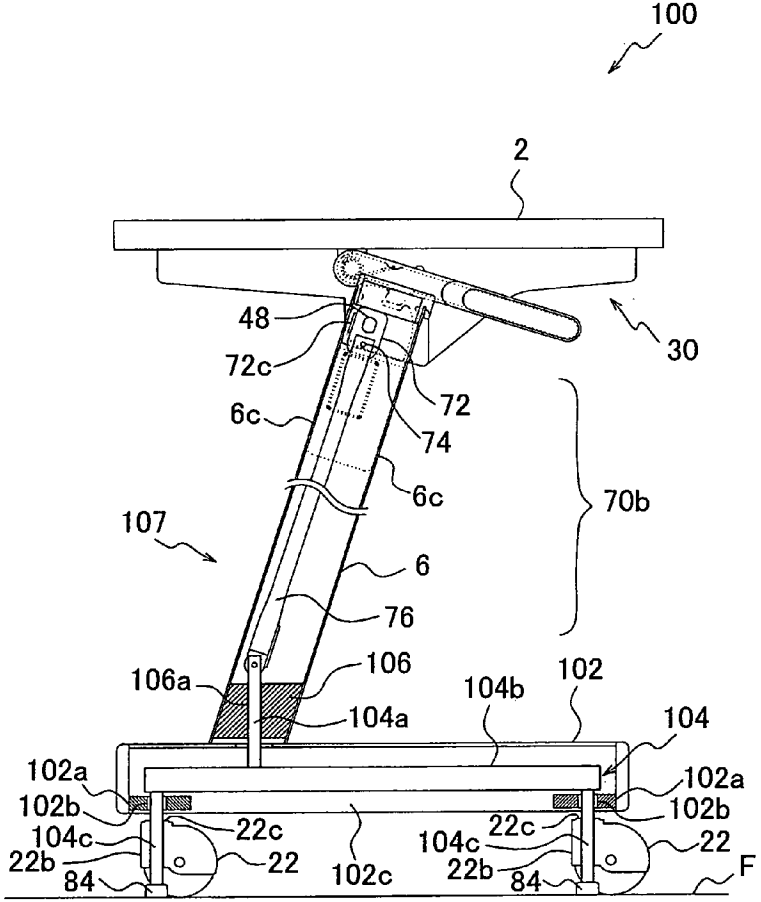
FIG. 20A is a side elevational view showing an appearance of a movable desk of modified example 2 when a top panel is in an in-use position.

When partially modified, the brake mechanism 70 in the movable desk 1 of the present embodiment may be applied to a movable desk 100 in Modification 2 including a leg support 102 which is different from the leg support 7 in the movable desk 1. A description of the movable desk 100, to which the brake mechanism 70*b* which is partially modified is applied, will be provided below with reference to FIG. 20A and FIG. 20B. In FIG. 20A and FIG. 20B, a leg pole 6 and the leg support 102 are shown as partial cross-sectional views taken along a vertical plane and as partial transparent views, in order to show the structure of a brake mechanism 70*b*.

The movable desk 100 of the present embodiment is configured to be immovable relative to a floor surface F when a top panel 2 is in a substantially horizontal in-use position and movable relative to the floor surface F when the top panel 2 is in a substantially vertical storage position.

As shown in FIG. 20A and FIG. 20B, the movable desk 100 includes the top panel 2, the pair of top panel support portions 30, a pair of legs 107 and the pair of brake mechanisms 70*b*.

The top panel 2 is made of a rectangular plate material. The pair of top panel support portions 30 are secured to an under surface of the top panel 2 at respective longitudinal end portions of the top panel 2. The pair of legs 107 rotatably support the top panel 2 and the top panel support portion 30 between the in-use position and the storage position. The pair of brake mechanisms 70*b* are provided inside the pair of legs 107, respectively, in order to prevent movement of the movable desk 100 when the top panel 2 is in the in-use position.

The pair of legs 97 include the leg poles 6 and a pair of leg support 102, respectively. Each of the leg poles 6 is disposed in an upper and lower direction with an upper end of the leg pole 6 slightly slanting rearward.

Each of the pair of leg supports 102 is provided at a lower end of each of the leg poles 6 so as to horizontally extend in the front and rear direction. The leg support 102, including a hollow portion 102*c* extending in the front and rear direction, is connected to the leg pole 6 at a connecting portion slightly rearward of the front end of the leg support 102. Abutment portions 102*a* are provided in respective lower end portions of front and rear ends of the leg support 102. Each of the abutment portions 102*a* includes an insertion hole 102*b* through which a part of the brake mechanism 70*b* is insertable. An undersurface of the leg support 102 is a free surface except in regions in which the abutment potions 102*a* are provided. The hollow portion 102*c* in the leg support 102 is connected to a hollow portion of an inside of the leg pole 6 in the connecting portion with the leg pole 6.

Each of the brake mechanisms 70*b* is provided inside the leg pole 6 and the leg support 102 in order to prevent movement of the movable desk 100 when the top panel 2 is in the in-use position. The brake mechanism 70*b* includes the cam 72, the synchronization rod 76, the stopper portion 104, the pair of stoppers 84, and a guide member 106.

The cam 72 is connected to a cam shaft 48. The synchronization rod 76 includes one end swingably connected to the cam 72. The stopper portion 104 includes one end swingably connected to a swingable end of the synchronization rod 76 through a connection fitting 78. The stoppers 84 are connected to an undersurface of the stopper portion 104. The guide member 106 is provided in a lower end portion of the hollow leg pole 6.

The stopper portion 104 includes a horizontal section 104*b*, a rod connecting section 104*a*, and stopper connecting sections 104*c*.

The horizontal section 104*b* extending in the front and rear direction is housed inside the hollow portion 102 of the leg support 102.

The rod connecting section 104*a* upwardly extends from the horizontal section 104*b* in a connecting portion of the leg support 102 with the leg pole 6. The rod connecting section 104*a* has a rod-like configuration and includes one end connected to the horizontal section 104*b* and the other end with an insertion hole (not shown) extending in a direction perpendicular to an axis of the rod connecting section 104*a*.

The stopper connecting sections 104*c* downwardly extend from respective front and rear ends of the horizontal section 104*b*. Each of the stopper connecting sections 104*c* has a rod-like configuration and includes one end connected to the horizontal section 104*b* and the other end having a screw hole (not shown) into which the stopper 84 is screwable.

The guide member 106 has a block-like configuration and includes a hollow portion 106*a* through which the rod connecting section 104*a* of the stopper portion 104 is insertable. The guide member 106 is fixed in the lower end portion of the hollow leg pole 6 such that the hollow portion 106*a* is arranged in a vertical direction.

In a state where the rod connecting section 104*a* is inserted through the hollow portion 106*a* of the guide member 106 such that the end with the insertion hole is disposed between a pair of parallel flat portions 78*b* of the connection fitting 78 above the guide member 106, a pin 80 is inserted through pin holes 78*a* formed in the flat portions 78*b* and the insertion hole. Then, the stopper portion 104 is supported by a pin 80 in a swingable manner with respect to the connection fitting 78, and thus the stopper portion 104 is swingably connected to the synchronization rod 76.

The stopper connecting sections 104*c* are inserted through respective insertion holes 102*b* formed in the abutment portions 102*a* at the front and rear ends of the leg support 102, and extend downward from the leg support 102. The stopper connecting sections 104*c* are subsequently inserted through tubular portions 22*b* of the caster main bodies 22, and thus through the casters main bodies 22. In this state, the stoppers 84 are screwed with respective screw holes at the ends of the stopper connecting sections 104*c*.

In the movable desk 100 configured as above, when the top panel 2 is in the substantially horizontal in-use position, as shown in FIG. 20A, the cam 72 is located such that a base portion 72*c* is parallel to a first side wall 6*c* of the leg pole 6. A pin 74 serving as a connecting point with the synchronization rod 76 is located below a rotation center of the cam 72, i.e., a center of the cam shaft 48.

In this case, the synchronization rod 76 is located at a lowest position inside the leg pole 6, and the stoppers 84 contact the floor surface F. Accordingly, the movable desk 100 is secured so as not to move when the top panel 2 is in the in-use position due to friction between the stoppers 84 and the floor surface F. Although the caster main bodies 22, axially pivotable around the respective stopper connecting sections 104, contact the floor surface F, upper end surfaces 22*c* of the respective tubular portions 22*b* do not contact the abutment portions 102*a*, and thus the movable desk 100 is immovable.

When the top panel 2 is rotated upward to the substantially vertical storage position (a position forming an angle of approximately 80 degrees between the top panel 2 and the floor surface F in Modification 2 embodiment) as shown in FIG. 20B, the cam 72 is rotated with the top panel 2 in a counterclockwise direction. At the same time, the position of the pin 74 as the connecting point with the synchronization rod 76 is also rotated to be located obliquely right below the rotation center of the cam 72.

At this time, the synchronization rod 76 is moved from the lowest position to a highest position inside the leg pole 6, the rod connecting section 104*a* inserted through the hollow portion 106*a* of the guide member 106 is moved vertically upward in a sliding manner inside the hollow portion 106*a*.

Accordingly, an entirety of the stopper portion 104 is moved vertically upward, and thereby the stoppers 84 provided to the respective ends of the stopper connecting sections 104*c* are moved vertically upward to be separated from the floor surface F. In this state, the upper end surfaces 22*c* of the respective tubular portions 22*b* of the caster main bodies 22 abut the abutment portions 102*a* of the leg support 102, and thus, the movable desk 100 becomes movable by the caster main bodies 22.

When the top panel 2 is pushed downward to be rotated back to the in-use position, the cam 72 is rotated with the top panel 2 in a clockwise direction, and the pin 74 is moved to be located again below the rotation center of the cam 72.

At this time, the synchronization rod 76 is moved downward, and the rod connecting section 104*a* inserted through the hollow portion 106*a* of the guide member 106 is moved vertically downward in a sliding manner inside the hollow portion 106*a*. Then, the stoppers 84 are brought into contact with the floor surface F. In this case, the stoppers 84 are brought into contact with the floor surface F in the middle of the rotation of the top panel 2 to the in-use position When the rotation of the top panel 2 proceeds further, the cam 72 is pushed upward through the stopper portion 104 and the synchronization rod 76 due to a repulsive force from the floor surface F on the stoppers 84. When the cam 72 is pushed upward, the cam shaft 48 connected to the cam 72 and the shaft portion 39 including the cam shaft 48 are pushed upward. As a result, the leg pole 6 connected to the shaft portion 39 is pushed upward. Thus, the upper end surfaces 22*c* of the respective tubular portions 22*b* of the caster main bodies 22 are separated from the abutment portions 102*a* of the leg support 102.

According to the movable desk 100 as described above, when the top panel 2 is rotated to the in-use position, the synchronization rod 76 and an entirety of the stopper portion 104 are moved downward through the rotation of the cam 72. As a result, the stoppers 84 are brought into contact with predetermined positions of the floor surface F. That is, the movable desk 100 can be securely fixed to the floor surface F by a simple structure.

When the top panel 2 is rotated, only the synchronization rod 76, the stopper portion 104, and the stoppers 84 are upwardly and downwardly moved. Accordingly, a user may easily rotate the top panel 2 even upward to the storage position without being required to apply a large force to rotate the top panel 2.

In the movable desk 1 of the present embodiment, the cam shaft 48 of the cam 72 is directly connected to the stepped rotary shaft 38 as the rotation shaft of the top panel 2 such that the cam 72 is rotated in an interlocking manner with the top panel 2. The cam shaft 48, however, may be rotated in an interlocking manner with the top panel 2, for example, by using a linking mechanism which links the cam shaft 48 to the stepped rotary shaft 38.

The brake mechanism 70 need not necessarily be disposed within the leg 4, but may be disposed, for example, along an outer surface of the side wall of the leg pole 6. Alternatively, the brake mechanism 70 may be provided, for example, separate from the leg 4 under a central portion of the top panel 2.

What is claimed is:

1. A desk, comprising:

a top panel; and at least one leg portion, wherein the at least one leg portion includes:

a rectangular-pole-shaped leg pole that supports the top panel; and a leg support that has at least a part abutting a floor surface and is attached to the leg pole so as to support the leg pole, wherein the leg support includes:

a leg support body portion; and a connection member, wherein the leg support body portion and the connection member respectively include an engagement groove that engages with the leg pole, and the engagement groove has an abutting surface formed at a corner where a corner portion of the leg pole is received, the abutting surface forming a space formed by the engagement groove into a shape where the corner is chamfered, further including a fastening device for fastening and connecting the leg support body portion and the connection member in a state where the leg support body portion and the connection member are engaged with the leg pole via the engagement groove, and wherein the corner portion of the leg pole and the abutting surface of the engagement groove are configured to have close contact with each other in a state where the leg support body portion and the connection member are attached to the leg pole and the leg support body portion and the connection member are connected by the fastening device.

2. The desk according to claim 1, wherein the engagement groove is formed by a pair of side surfaces that are parallel to each other and a bottom surface that is connected to each of the pair of side surfaces at an angle of 90 degrees, and the abutting surface is so formed as to connect the side surfaces and the bottom surface.

3. The desk according to claim 2, wherein the abutting surface is formed so that an angle between the abutting surface and the bottom surface and an angle between the abutting surface and the side surface are equal.

4. The desk according to claim 1, wherein the fastening device is arranged around the leg pole so as to connect the leg support body portion and the connection member around the leg pole.

5. The desk according to claim 1, wherein the fastening device connects the leg support body portion and the connection member at at least two positions which are apart from the engagement groove and the leg pole and are parallel to each other with the engagement groove and the leg pole sandwiched therebetween.

6. The desk according to claim 1, wherein the leg pole includes at least one engaged portion to be engaged with the leg support, and wherein the leg support includes an engaging portion that engages with the engaged portion of the leg pole thereby to position the leg support at a predetermined position of the leg pole.

7. The desk according to claim 1, wherein the leg pole includes at least one engaged portion to be engaged with the connection member, wherein the connection member includes:

at least one engaging portion that engages with the at least one engaged portion of the leg pole thereby to position the connection member at a predetermined position of the leg pole; and connecting portions that are connected to the leg support body portion, the connecting portions being provided on the connection member in a manner displaced at least in a vertical direction from the at least one engaging portion in a state where the connection member is attached to the leg pole, and wherein the connection member is configured to be able to be positioned on the leg pole in a first configuration where the connecting portions are disposed vertically higher than the at least one engaging portion and also configured to be able to be positioned on the leg pole in a second configuration, which is obtained by turning the first configuration upside down, where the connecting portions are disposed vertically lower than the at least one engaging portion.

8. The desk according to claim 1, wherein the abutting surface is provided along the whole corner of the engagement groove, where the corner portion of the leg pole is received, and abuts the corner portion of the leg pole linearly.

9. The desk according to claim 1, wherein the abutting surface is formed on the engagement groove in the leg support body portion.

10. The desk according to claim 1, wherein the leg support body portion and the connection member are formed by separate members.

11. The desk according to claim 1, wherein the leg support body portion and the connection member are formed by an integral member.

12. A desk, comprising:

a top panel; and at least one leg portion, wherein at least one of the at least one leg portion includes:

a pole-shaped leg pole that supports the top panel; and a leg support that has at least a part abutting a floor surface and is attached to the leg pole so as to support the leg pole, wherein the leg support includes, as devices to connect with the leg pole:

a pair of sandwiching portions that abut the leg pole and are capable of sandwiching the leg pole therebetween; and a fastening device that fastens and connects the pair of sandwiching portions in a state where the leg pole is sandwiched by the pair of sandwiching portions, wherein the leg support is divided into two members, each divided member including the sandwiching portion;

wherein one of the two members constituting the leg support is a leg support body portion that abuts the floor surface and supports the leg pole;

wherein the other of the two members is a connection member that sandwiches the leg pole between the connection member and the leg support body portion;

wherein the leg pole includes at least one engaged portion to be engaged with the connection member;

wherein the connection member includes:

at least one engaging portion that engages with the at least one engaged portion of the leg pole thereby to position the connection member at a predetermined position of the leg pole; and connecting portions that are connected to the leg support body portion, the connecting portions being provided on the connection member in a manner displaced at least in a vertical direction from the at least one engaging portion in a state where the connection member is attached to the leg pole, and wherein the connection member is configured to be able to be positioned on the leg pole in a first configuration where the connecting portions are disposed vertically higher than the at least one engaging portion and also configured to be able to be positioned on the leg pole in a second configuration, which is obtained by turning the first configuration upside down, where the connecting portions are disposed vertically lower than the at least one engaging portion.

13. The desk according to claim 12, wherein there are two engaged portions and two engaging portions, wherein there are two connecting portions, and wherein an arrangement direction of the engaging portions and an arrangement direction of the connecting portions are parallel.

14. The desk according to claim 12, wherein there are two leg portions and each leg portion includes the pole-shaped leg pole that supports the top panel, and wherein the engaged portion is provided on a surface of each of the leg poles at a side where the leg poles are facing each other.

15. A desk, comprising:

a top panel; and at least one leg portion, wherein at least one of the at least one leg portion includes:

a pole-shaped leg pole that supports the top panel; and a leg support that has at least a part abutting a floor surface and is attached to the leg pole so as to support the leg pole, wherein the leg support includes, as devices to connect with the leg pole:

a pair of sandwiching portions that abut the leg pole and are capable of sandwiching the leg pole therebetween; and a fastening device that fastens and connects the pair of sandwiching portions in a state where the leg pole is sandwiched by the pair of sandwiching portions, wherein the leg support is divided into two members, each divided member including the sandwiching portion; and wherein the fastening device connects the two members of the leg support at at least two positions which are apart from the sandwiching portions and the leg pole and are parallel to each other with the sandwiching portions and the leg pole sandwiched therebetween.

* * * * *